US009057519B1

(12) United States Patent
Paynton et al.

(10) Patent No.: US 9,057,519 B1
(45) Date of Patent: Jun. 16, 2015

(54) CHIMNEY CAP

(75) Inventors: William C. Paynton, North Attleboro, MA (US); Richard H. Paynton, Dighton, MA (US)

(73) Assignee: Improved Consumer Products, Inc., North Attleboro, MA (US)

( * ) Notice: Subject to any disclaimer, the term of this patent is extended or adjusted under 35 U.S.C. 154(b) by 743 days.

(21) Appl. No.: 12/776,527

(22) Filed: May 10, 2010

Related U.S. Application Data

(63) Continuation-in-part of application No. 11/879,436, filed on Jul. 17, 2007, now Pat. No. 7,713,114.

(51) Int. Cl.

| | |
|---|---|
| ***F23L 17/02*** | (2006.01) |
| *F23L 17/12* | (2006.01) |
| *F23L 17/04* | (2006.01) |
| *F24F 13/08* | (2006.01) |

(52) U.S. Cl.
CPC ..... *F23L 17/02* (2013.01); *F23L 17/12* (2013.01); *F23L 17/04* (2013.01); *F24F 13/082* (2013.01)

(58) Field of Classification Search
CPC ..... F23L 17/02; F23L 17/12; F23L 17/04
USPC ..... 454/3, 4, 8, 12–14, 44, 34–38, 367, 47; 138/156–171; 110/119
See application file for complete search history.

(56) References Cited

U.S. PATENT DOCUMENTS

| | | | | |
|---|---|---|---|---|
| 329,993 | A | 11/1885 | Barker | |
| 1,301,096 | A | 4/1919 | Brockest | |
| 1,783,406 | A | 12/1930 | Cibulas | |
| 1,888,290 | A | 11/1932 | Rhinow | |
| 2,242,468 | A | 5/1941 | Holub | |
| 2,381,178 | A * | 8/1945 | Munyon | 52/244 |

(Continued)

FOREIGN PATENT DOCUMENTS

| | | | |
|---|---|---|---|
| DE | 3829858 A1 * | 6/1989 | F23J 13/06 |
| EP | 8527209 | 11/1985 | |

(Continued)

OTHER PUBLICATIONS

Improved Consumer Products, Inc., 2005 Product Catalog, published on www.chinmeycaps.com as included in parent U.S. Appl. No. 11/879,436, now U.S. Patent No. 7,713,114, Issued May 11, 2010.

*Primary Examiner* — Alissa Tompkins
*Assistant Examiner* — Anthony Kandare
(74) *Attorney, Agent, or Firm* — John Brooks Law LLC; John J Brooks, III

(57) ABSTRACT

A chimney cap assembly capable of being secured to a chimney or flue of either air-cooled or non-air-cooled types, embodiments of the chimney cap assembly including a collar member and an overlap joint. The collar member having a compressible portion with an outside circumference that is compressible to a compressed circumference smaller than an opening of the chimney or flue. The collar member also having an overlap joint with a pivot whereby the compressible portion of the collar member can be compressed. Embodiments of the chimney cap assembly include the collar member being attached to a base. Embodiments of the cap assembly also include means to form a ledge on the chimney or flue and a lower mesh structure. Also disclosed are embodiments of kits to provide such means to form a ledge and a lower mesh structure.

3 Claims, 23 Drawing Sheets

(56) References Cited

U.S. PATENT DOCUMENTS

| | | | | | |
|---|---|---|---|---|---|
| 2,581,992 | A | * | 1/1952 | Wilder | 454/35 |
| 2,628,551 | A | | 2/1953 | Leigh | |
| 2,803,184 | A | * | 8/1957 | Wasserman | 454/36 |
| 2,878,838 | A | | 3/1959 | Budge et al. | |
| 2,988,982 | A | * | 6/1961 | Brewer | 454/34 |
| 2,994,260 | A | | 8/1961 | Millett | |
| 3,018,714 | A | * | 1/1962 | Brewer | 454/39 |
| 3,307,337 | A | * | 3/1967 | Freitas, Jr. et al. | 55/500 |
| 3,435,816 | A | * | 4/1969 | De Werth | 126/85 B |
| 3,543,670 | A | * | 12/1970 | Stone | 454/367 |
| 3,650,198 | A | * | 3/1972 | Stone | 454/37 |
| 3,874,363 | A | * | 4/1975 | Biedenbender et al. | 126/85 B |
| 4,325,291 | A | | 4/1982 | Paynton et al. | |
| 4,384,617 | A | | 5/1983 | Mueller | |
| 4,386,571 | A | * | 6/1983 | Dortzbach | 110/119 |
| 4,466,340 | A | | 8/1984 | Briner | |
| 4,549,473 | A | | 10/1985 | Alexander et al. | |
| 4,697,500 | A | * | 10/1987 | Hisey | 454/35 |
| 4,777,871 | A | | 10/1988 | Stowell | |
| 4,846,512 | A | | 7/1989 | Karakawa | |
| 4,878,326 | A | | 11/1989 | Sass | |
| 1,337,731 | A | | 4/1990 | Speaks | |
| 5,025,712 | A | | 6/1991 | Perry | |
| 5,161,478 | A | * | 11/1992 | Strieb | 114/361 |
| 5,228,882 | A | * | 7/1993 | Kraemer | 454/4 |
| 5,234,582 | A | | 8/1993 | Savoie | |
| 5,609,522 | A | | 3/1997 | Szwartz | |
| 5,848,931 | A | * | 12/1998 | Dortzbach | 454/4 |
| 6,805,627 | B2 | * | 10/2004 | Marts et al. | 454/368 |
| 6,852,023 | B2 | | 2/2005 | Hediger et al. | |
| 6,997,798 | B2 | * | 2/2006 | Jensen | 454/4 |
| 7,014,555 | B1 | | 3/2006 | Issod | |
| 7,074,121 | B2 | * | 7/2006 | Zhou et al. | 454/8 |
| 7,713,114 | B1 | * | 5/2010 | Paynton et al. | 454/12 |
| 8,083,574 | B2 | * | 12/2011 | Arnold et al. | 454/4 |
| 8,246,430 | B1 | * | 8/2012 | Paynton et al. | 454/4 |
| 8,461,715 | B2 | * | 6/2013 | Lee et al. | 290/55 |
| 2002/0092475 | A1 | * | 7/2002 | Paynton et al. | 119/51.01 |
| 2003/0124968 | A1 | * | 7/2003 | Howell et al. | 454/16 |
| 2004/0221522 | A1 | * | 11/2004 | Hendricks | 52/198 |
| 2007/0033888 | A1 | * | 2/2007 | Hendricks | 52/198 |
| 2007/0095339 | A1 | * | 5/2007 | Lyons et al. | 126/319 |
| 2008/0160894 | A1 | * | 7/2008 | Eberhardt et al. | 454/4 |
| 2008/0256883 | A1 | * | 10/2008 | Fleckenstein | 52/244 |

FOREIGN PATENT DOCUMENTS

| | | | | | |
|---|---|---|---|---|---|
| EP | 0182534 | | | 5/1986 | |
| GB | 2166537 | | | 5/1986 | |
| JP | 60152815 | A | * | 8/1985 | F23L 17/02 |
| JP | 60185015 | A | * | 9/1985 | F23L 17/02 |
| WO | WO 8606818 | A1 | * | 11/1986 | F23L 17/02 |

* cited by examiner

CHIMNEY CAP

CROSS-REFERENCE TO RELATED APPLICATIONS

This application claims benefit of and is a Continuation in Part of co-pending U.S. patent application Ser. No. 11/879,436 to William C. Paynton et al. filed on 17 Jul. 2007 and entitled "CHIMNEY CAP", the entire contents of which is incorporated herein by reference. The application is also related to co-pending U.S. patent application Ser. No. 12/478,838 to William C. Paynton et al. filed Jun. 5, 2009 and entitled "CHIMNEY CAP", the entire contents of which are incorporated herein by reference.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

1. Field of the Invention

The present invention relates generally to chimney caps and more particularly to a chimney cap that is universal in construction and that can be used with either air-cooled and non-air-cooled chimneys.

2. Description of the Prior Art

Chimney caps are presently provided in many different shapes and forms. In one sense chimney caps can be basically broken down into two categories, namely those used with regular or non-air-cooled chimney structures and those used with air-cooled chimney structures. Presently, there are two separate cap designs that are used, one for use with non-cooled chimney structures and a different cap for use with air cooled chimney structures. Thus, the cap is specifically designed for each chimney type to which it is to be mounted. By way of example these different types of chimney caps are shown in the 2005 Product Catalog of Improved Consumer Products, Inc. on page 12 and identified as respective models WSA and WSA-TDW. Reference is now also made to FIGS. 1-4 herein for an illustration of these existing chimney caps. FIG. 1 is a perspective view of a prior art chimney cap used with a non-air-cooled chimney structure. FIG. 2 is a cross-sectional view taken along lines 2-2 of FIG. 1. FIG. 3 is a perspective view of a prior art chimney cap used with an air-cooled chimney structure. FIG. 4 is a cross-sectional view taken along line 4-4 of FIG. 3.

In the first embodiment in FIGS. 1 and 2 the chimney cap includes a base 10 that has the collar 14 depending therefrom. As shown in FIG. 2, the collar 14 extends into the chimney or flue member 15. The collar is formed with an overlap edge 13 that makes the collar somewhat compressible so that it can be fit inside the chimney member 15. The installer can press on the collar to reduce the diameter thereof and once inserted in the flue it expands back toward its original diameter to hold the cap in place. The chimney cap also includes the top 12 and mesh screen 16. The mesh screen 16 assists in containing sparks within the cap. A hoop 18 is supported above the collar 14. The mesh screen 16 is supported on the periphery of the base 10. The mesh screen 16 and top 12 are maintained in place by any fastening means such as the top fastener 20 engaging with the hoop 18. In FIG. 2 it is noted that the base 10 rests directly on the top edge of the chimney member 15 and that the exhaust flow, as depicted by arrows 17, is through the collar 14 and peripherally outward through the mesh screen 16.

In the second embodiment shown in FIGS. 3 and 4 the chimney cap includes a base 30 that has the collar 34 depending therefrom. As shown in FIG. 4, the collar 34 extends into the chimney structure 35. The collar is formed with an overlap edge 33 that makes the collar somewhat compressible so that it can be fit inside the chimney structure 35. The chimney cap also includes the top 32 and top mesh screen 36. The top mesh screen 36 assists in containing sparks within the cap. A hoop 38 is supported above the collar 34. The top mesh screen 36 is supported on the periphery of the base 30. The top mesh screen 36 and top 32 are maintained in place by means of the top fastener 40 engaging with the hoop 38.

In FIG. 4 it is noted that the base 30 is provided with three wings 31 that are each attached to the base 30. The bottom edge of each wing 31 is adapted to rest directly on the top edge of the chimney structure 35 and the exhaust flow, as depicted by arrows 37, is through the collar 34 and peripherally outward through the mesh screen 36. FIG. 4 also shows additional details of the chimney structure 35 which includes separate air cool ducts 35A and 35B. FIG. 4 also shows the air flow through the ducts as illustrated by the arrows 39. This flow is also about the wings 31 and between adjacent wings.

BRIEF SUMMARY OF THE INVENTION

The following summary is included only to introduce some concepts discussed in the Detailed Description below. This summary is not comprehensive and is not intended to delineate the scope of protectable subject matter, which is set forth by the claims presented.

The foregoing and other objects of an embodiment of the invention are attained by a chimney cap capable of being secured to a chimney or flue of either air cooled or non-air cooled type and comprising: a base; a collar member for insertion into a chimney or flue, said collar member having an outside circumference smaller than an opening of the chimney or flue and supported from the base; a mesh member that is supported from the base; and a top supported on the mesh member. The improvement comprises means supported from an outer surface of the collar member below the base and forming a ledge for support of the collar member from the chimney or flue.

A second feature of an embodiment of the present invention relates to a cap capable of being secured to a chimney or flue and comprising: a base; a collar member for insertion into the chimney or flue, with the collar member having an outside circumference smaller than an opening of the chimney or flue and supported from the base; a mesh member that is supported from the base; and a top supported on the mesh member, with the collar member having an overlap joint. The improvement comprises an overlap joint including a lower segment that extends substantially longitudinal of the collar member and a top segment that extends diagonal to the lower segment enabling compression of the diameter of the collar member. The collar member may be attached at its top to the base and the top segment is tapered terminating at the base.

In accordance with other aspects of an embodiment of the present invention the means forming a ledge may include a cut-out piece that is folded to form the ledge, with the ledge extending orthogonal to the outer surface of the collar member; plural cut-out pieces may be disposed at predetermined location about the collar member; the means forming a ledge may comprise plural separate means disposed at predetermined location about the collar member; the means forming a ledge may include a series of bolts disposed at intervals about the collar member and each extending outward radially; the means forming a ledge may include a band member having separately disposed ledge walls; the collar member may have an overlap joint and the overlap joint may include a lower segment that extends substantially longitudinal of the collar member and a top segment that extends diagonal to the lower segment enabling compression of the diameter of the collar member.

It is an object of one embodiment of the invention to provide a cap assembly capable of being secured to a chimney or flue of either air cooled or non-air cooled type having a base, a collar member for insertion into the chimney or flue, the collar member having an outside circumference smaller than an opening of the chimney or flue, the collar member depending from the base and at least one bolt disposed about the collar member and extending outward radially and forming a ledge for supporting the collar member from the chimney or flue.

It is another object of one embodiment of the invention to provide the chimney cap assembly wherein the collar member has an overlap joint having a lower segment that extends from a bottom termination point substantially longitudinal of the collar member to a transition point and a top segment that extends from the transition point to a top termination point. In some embodiments, the collar member further comprises an overlap joint having a pivot whereby a portion of the overlap joint is capable of moving or pivoting about the pivot compressing the outside circumference of the collar member at a bottom edge.

It is an object of one embodiment of the invention to provide the chimney cap assembly capable of being secured to a chimney or flue having a base, a collar member for insertion into the chimney or flue, the collar member depending from the base by a top edge of the collar member, the collar member having a compressible portion having an outside circumference that is compressible to a compressed circumference smaller than an opening of the chimney or flue; the collar member having an overlap joint having a bottom termination point on a bottom edge of the collar member and a pivot point proximal to the top edge of the collar member, and a means to fasten securing the top edge of the collar member to the base at the pivot point whereby the compressible portion of the collar member can be compressed.

It is another object of one embodiment of the invention to provide a chimney cap assembly wherein the overlap joint has a lower segment extending from the bottom termination point substantially longitudinal of said collar member to a transition point and a top segment tapered from the transition point to a top termination point proximal to the top edge of the collar member. In some embodiments, the compressible portion of the collar member is elastically biased when uncompressed to an uncompressed circumference larger than an outside circumference of the top edge of the collar member.

It is an object of one embodiment of the invention to provide a universal cap assembly for a chimney cap having a collar member for insertion into the chimney or flue, the collar member having a top edge and a bottom edge, the top and bottom edges of the collar member each having an outside circumference, the bottom edge outside circumference elastically biased to a size larger than an inside circumference of an opening of the chimney or flue, and the collar member having an overlap joint with a pivot enabling movement of a portion of the overlap joint about the pivot whereby the bottom edge of the collar member can be compressed and the outside circumference of the bottom edge of the collar member can be made smaller than the opening of the chimney or flue. In some embodiments, the cap further includes a base attached to the top edge of the collar member.

It is another object of the invention to provide a universal cap assembly for a chimney cap having a means to attach a top to the universal cap assembly.

It is yet another object of the invention to provide a universal kit for a chimney cap having a collar member for securing the cap into a chimney or flue, the kit comprising a lower mesh structure having discharge openings, the lower mesh structure capable of being rolled upon itself to have an outside circumference larger than an outside circumference of a chimney or flue, the lower mesh structure having at least one elongated slot, at least one support rod sized to extend from a chimney cap through the elongated slot, and fastening means to secure the support rod to the lower mesh structure and the chimney cap whereby the lower mesh structure is wrapped around the outside circumference of the chimney or flue and secured to the chimney cap.

An object of some embodiments of the present invention is to provide a chimney cap that is more universal in construction and that can be used with both air cooled and non-air cooled chimneys.

Another object of some embodiments of the present invention is to provide an improved chimney cap structure in which the chimney collar is constructed and arranged so that it can be more readily compressed for insertion into virtually any type or style chimney.

Still another object of some embodiments of the present invention is to provide an improved chimney cap which is durable and long lasting.

An even further object of some embodiments of the invention is to provide an improved chimney cap that is inexpensive to manufacture and that is easy to install.

BRIEF DESCRIPTION OF THE SEVERAL VIEWS OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only embodiments of the invention and are not therefore to be considered to be limiting of its scope, the invention will be described and explained with additional specificity and detail through the use of the accompanying drawings in which.

These and other objects, advantages and novel features of the present invention will become apparent from the following detailed description of the invention when considered in conjunction with the accompanying drawings, in which.

DETAILED DESCRIPTION OF THE INVENTION

A chimney cap assembly will now be described in detail with reference to the accompanying drawings. It will be appreciated that, while the following description focuses on an assembly that does operates with common chimneys, the systems and methods disclosed herein have wide applicability. For example, the chimney cap assemblies described herein may be readily employed with building vents or exhausts. Notwithstanding the specific example embodiments set forth below, all such variations and modifications that would be envisioned by one of ordinary skill in the art are intended to fall within the scope of this disclosure.

Figure 10:
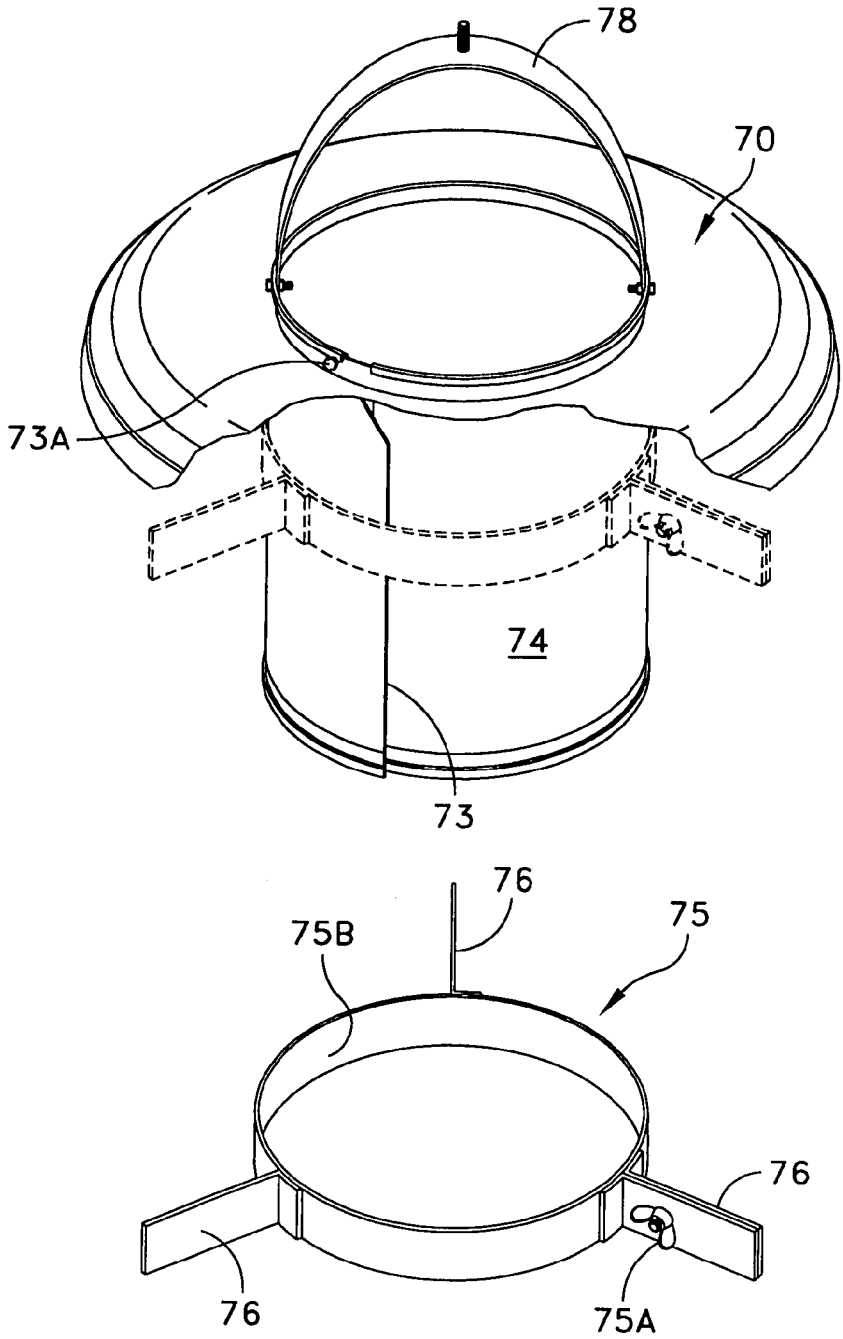
FIG. 10 is an exploded perspective view of an alternate embodiment of the chimney cap of the present invention.
Figure 11:
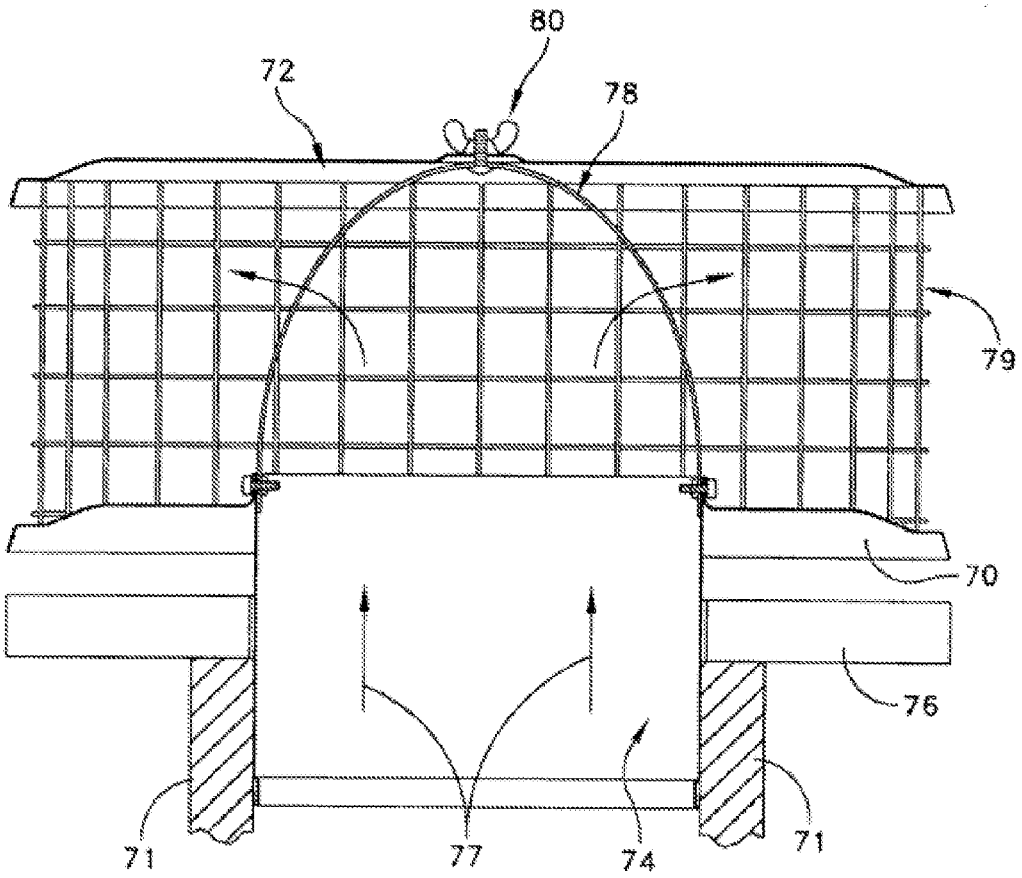
FIG. 11 is a cross-sectional view of the embodiment of FIG. 10.
Figure 12:
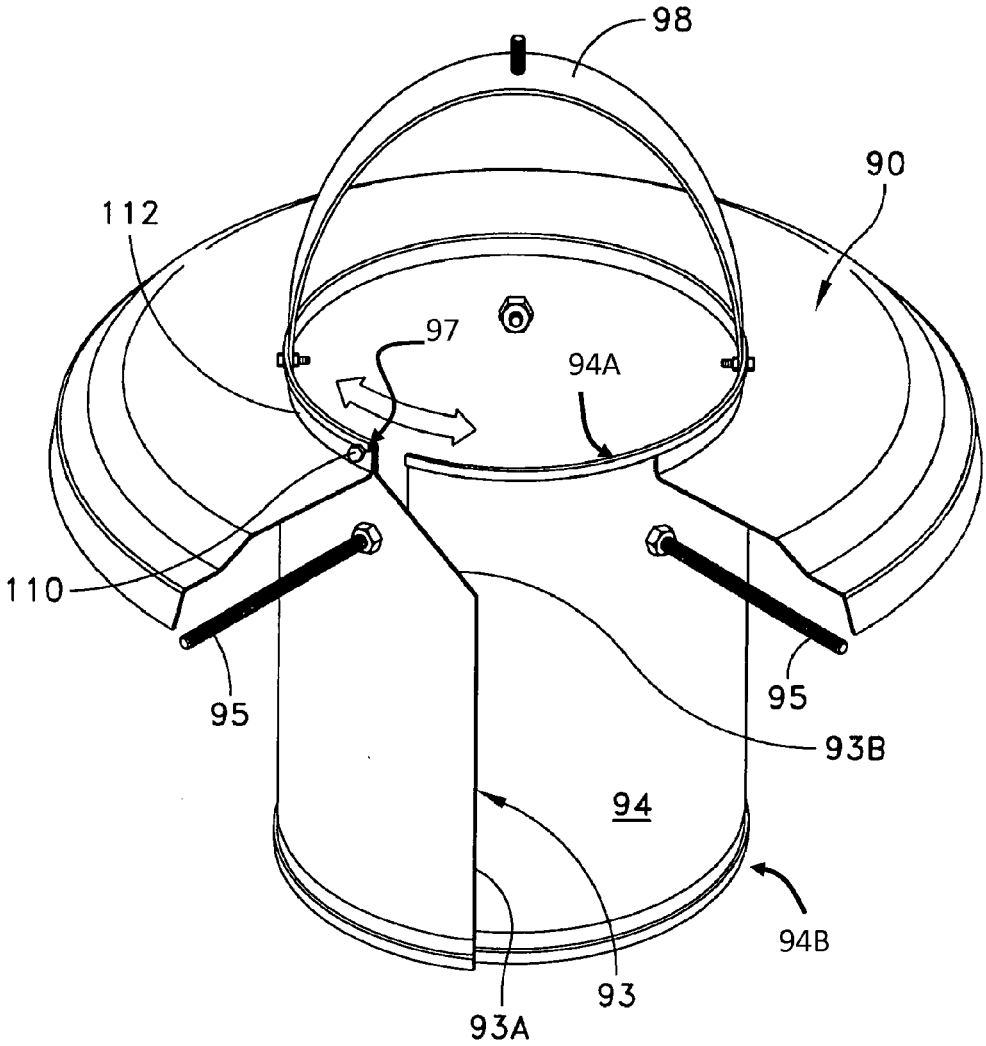
FIG. 12 is a perspective view of a further embodiment of the chimney cap of the present invention.
Figure 13:
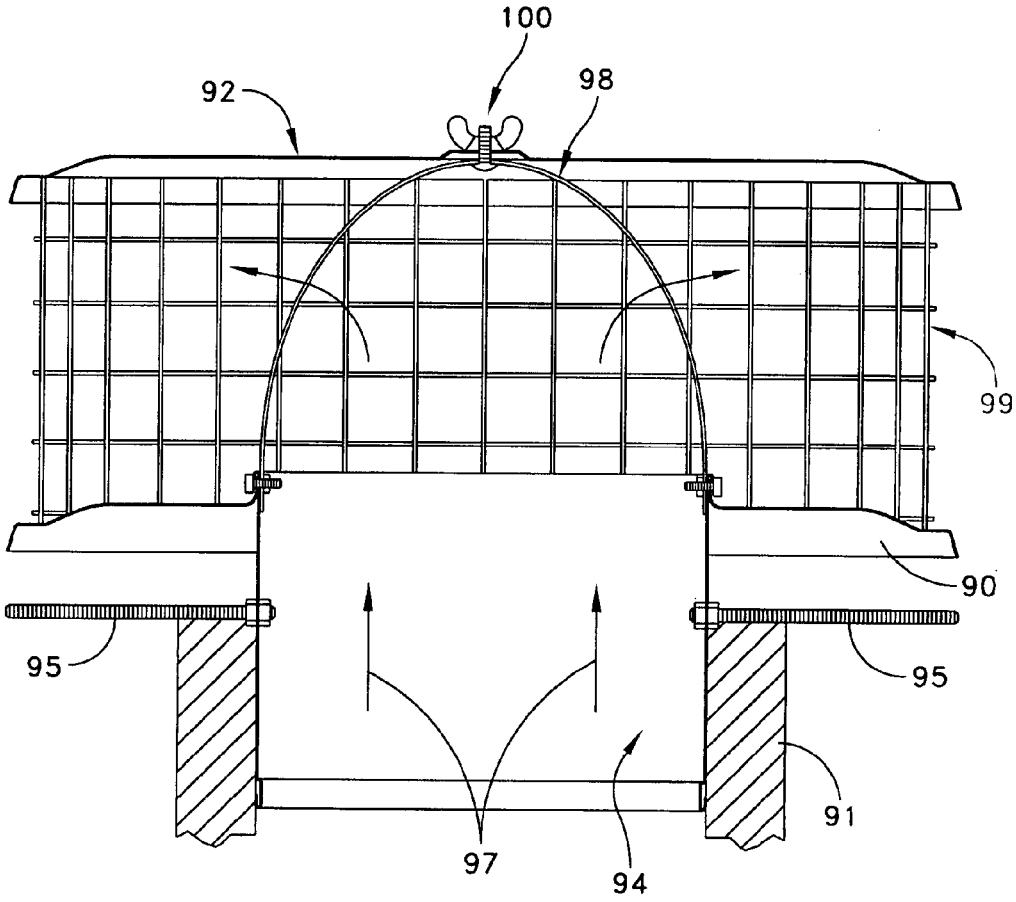
FIG. 13 is a cross-sectional view of the embodiment of FIG. 12.
Figure 14:
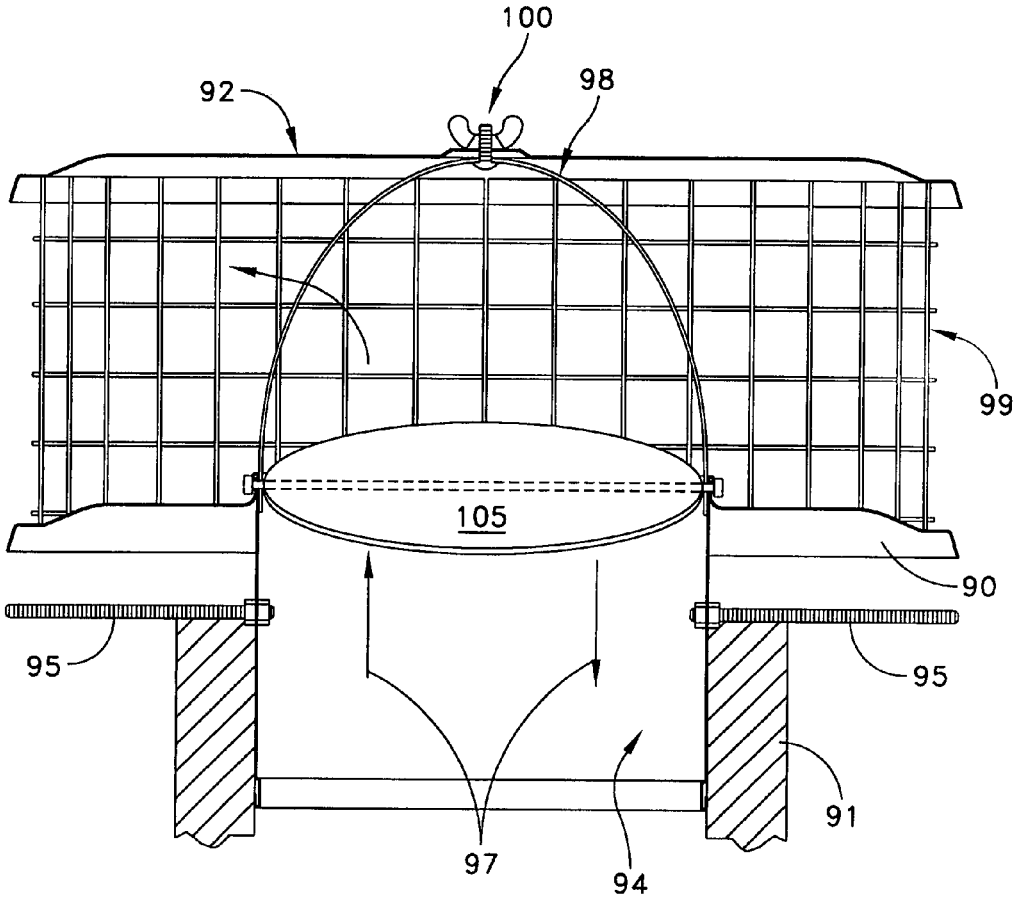
FIG. 14 is a cross-sectional view of the chimney cap of FIG. 12 with an added damper.

One embodiment of the present invention is shown in FIGS. 5-9. Another embodiment is shown in FIGS. 10 and 11. Another embodiment is shown in FIGS. 12-14. Each of these embodiments shows a chimney cap capable of being secured to a chimney or flue of either an air cooled or non-air-cooled type. This enables one to have only one type of chimney cap that can be used with either an air-cooled or non-air-cooled type chimney. The chimney cap generally includes a base, an annular collar member for insertion into a chimney or flue, an annular shaped mesh member that is supported from the base; and a top supported on the annular shaped mesh member.

Other embodiments of the present invention are shown in FIGS. 15-22 and are discussed below.

In the embodiment shown in FIGS. 5-9 the chimney cap includes a base 50 that has the collar member 54 depending therefrom. Although the collar will typically be attached to the rim of the base, it is also contemplated that the collar member may be attached to the rim at in different locations. As shown in, for example FIG. 7, the collar member 54 extends into the chimney structure 55. The collar is formed with an overlap joint 53 (FIGS. 5 and 6) that makes the collar somewhat compressible so that it can be fit inside the chimney structure 55. The chimney cap also includes the top 52 and top mesh screen 56. The top mesh screen 56 assists in containing sparks within the cap. A hoop 58 is supported above the collar member 54. The top mesh screen 56 is supported on the periphery of the base 50. The top mesh screen 56 and top 52 are maintained in place by means of the top fastener 60 engaging with the hoop 58.

It is understood and contemplated that embodiments of the hoop 58 can be made from a flat or solid material as well as a perforated, screen or mesh type material. For hoop embodiments with perforations, screen or mesh, the hoop can act as a spark arrestor and lower air flow restrictions through the chimney cap than would be created by some flat or solid hoop embodiments.

Although embodiments of the base can be shaped as shown and described, it is also contemplated that the base can be of any shape that allows air flow through the collar member while also helping constrain the circumference of the top edge of the collar member. For example, a ring connecting the top edge or fasteners connecting the ends of the collar member top edge can function as a base. The base can also include the shape of the top edge together with any type of constraint of the top edge such as connecting one end of the collar member top edge to the other or any other means of constraining the top edge so that is it relatively inelastic during compression of the bottom edge of the collar member.

Figure 1:
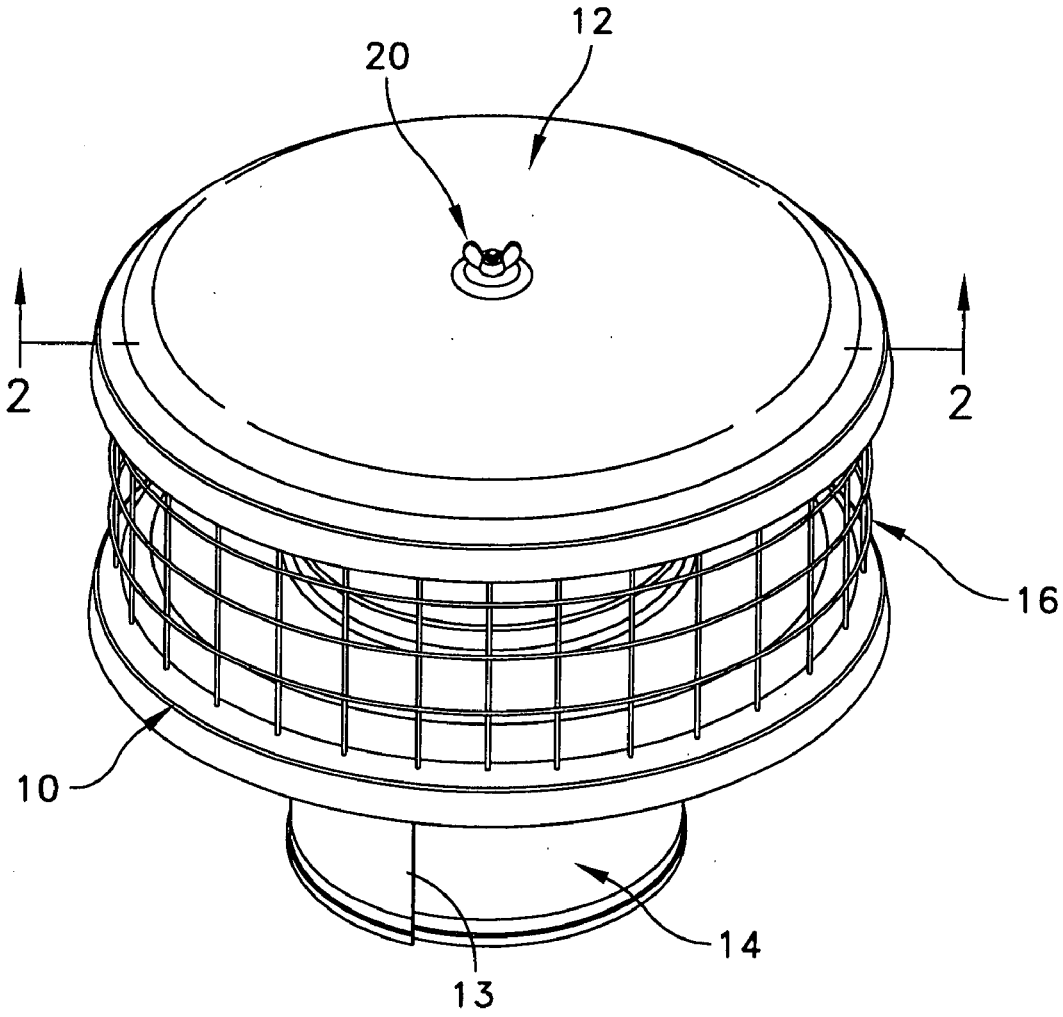
FIG. 1 (PRIOR ART)
FIG. 1 is a perspective view of a prior art chimney cap used with a non-air cooled chimney structure.
Figure 2:
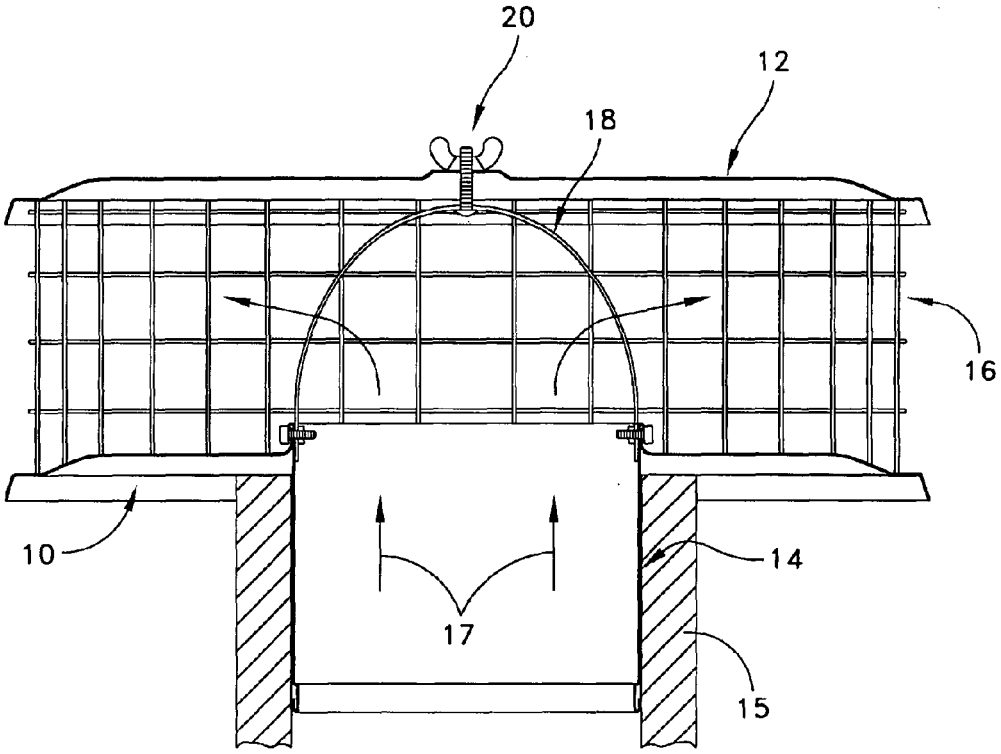
FIG. 2 (PRIOR ART)
FIG. 2 is a cross-sectional view taken along lines 2-2 of FIG. 1.
Figure 3:
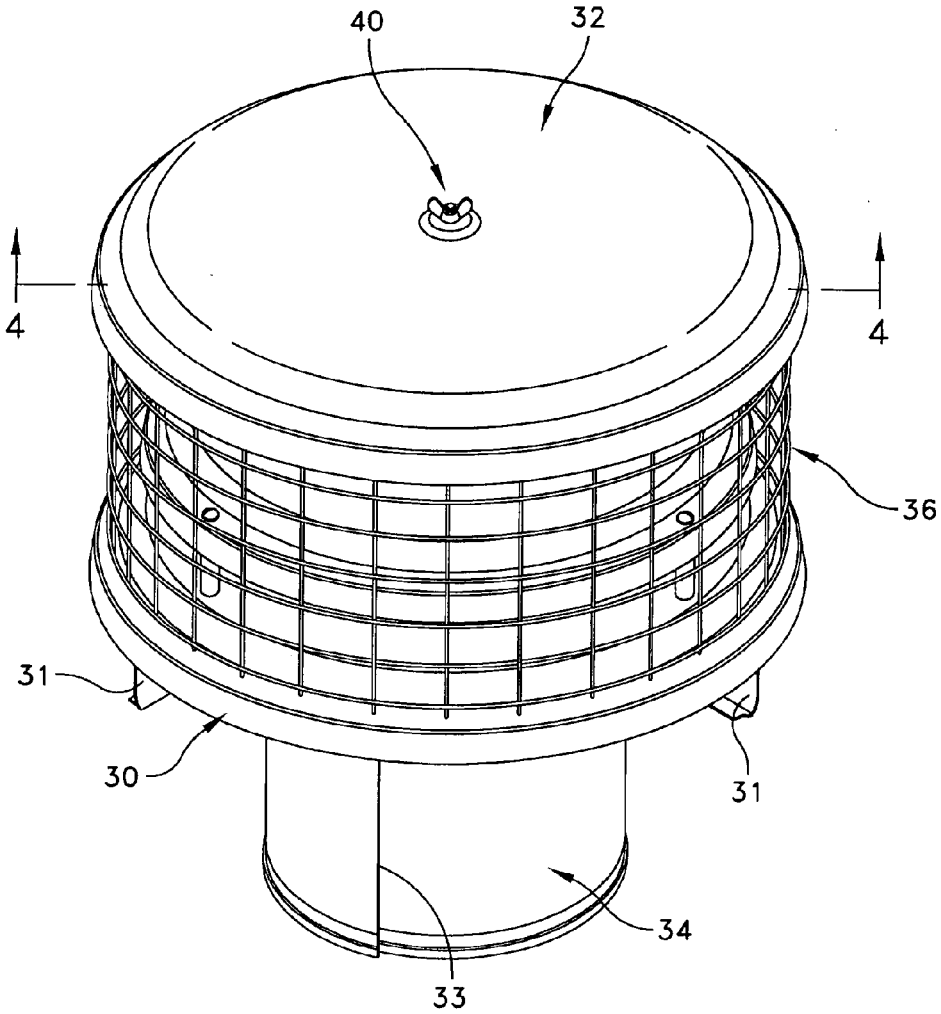
FIG. 3 (PRIOR ART)
FIG. 3 is a perspective view of a prior art chimney cap used with an air-cooled chimney structure.

One aspect of an embodiment of the present invention relates to the particular configuration of the overlap joint 53. In the past this joint was linear from bottom to top as shown in, for example, FIG. 3 where the top end of the joint is secured at the base. In the embodiments of FIGS. 5-14 the overlap joint includes a lower segment 53A that extends substantially longitudinal of the collar member and a top segment 53B that extends diagonal to the lower segment 53A enabling more ready compression of the diameter of the collar member 54. The collar member 54 may be attached at its top to the base 50 and the top segment 53B is tapered terminating at the top edge of the collar member, at the connection of the collar member to the base 50 or at a point close to the pivot. In embodiments, the top termination point is defined by a means to fasten the collar member to the base such as pivot fastener 110 shown and discussed in more detail in FIG. 12.

Figure 4:
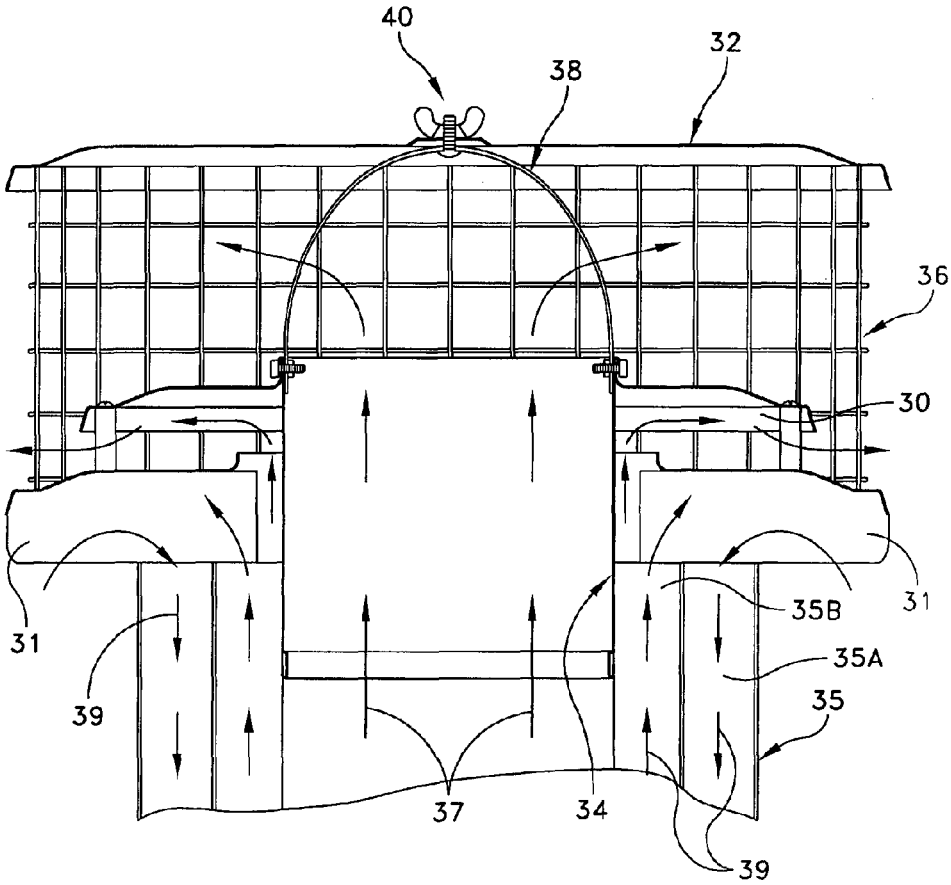
FIG. 4 (PRIOR ART)
FIG. 4 is a cross-sectional view taken along line 4-4 Of FIG. 3
Figure 5:
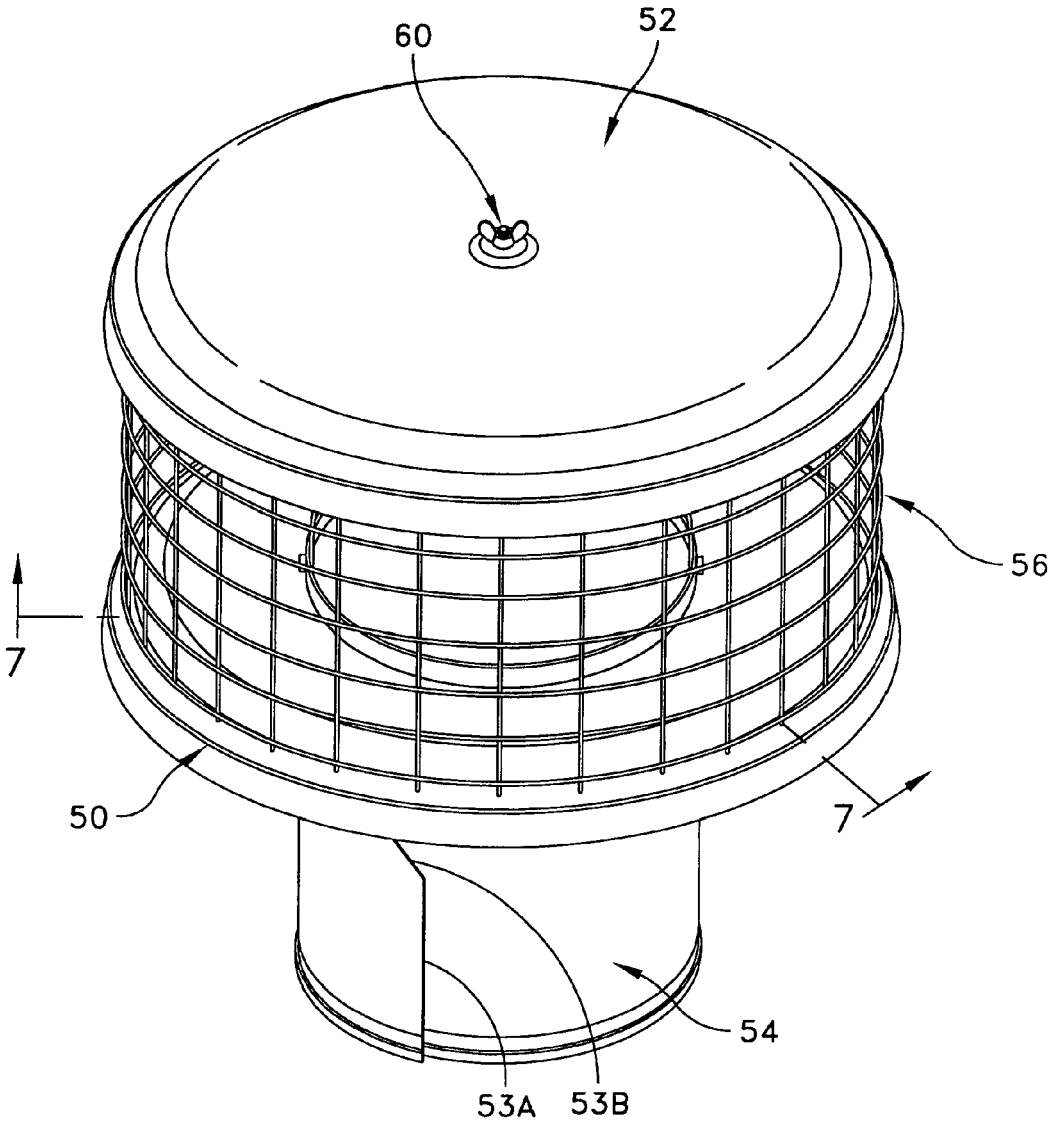
FIG. 5 is a perspective view of an embodiment of the chimney cap construction of the present invention
Figure 6:
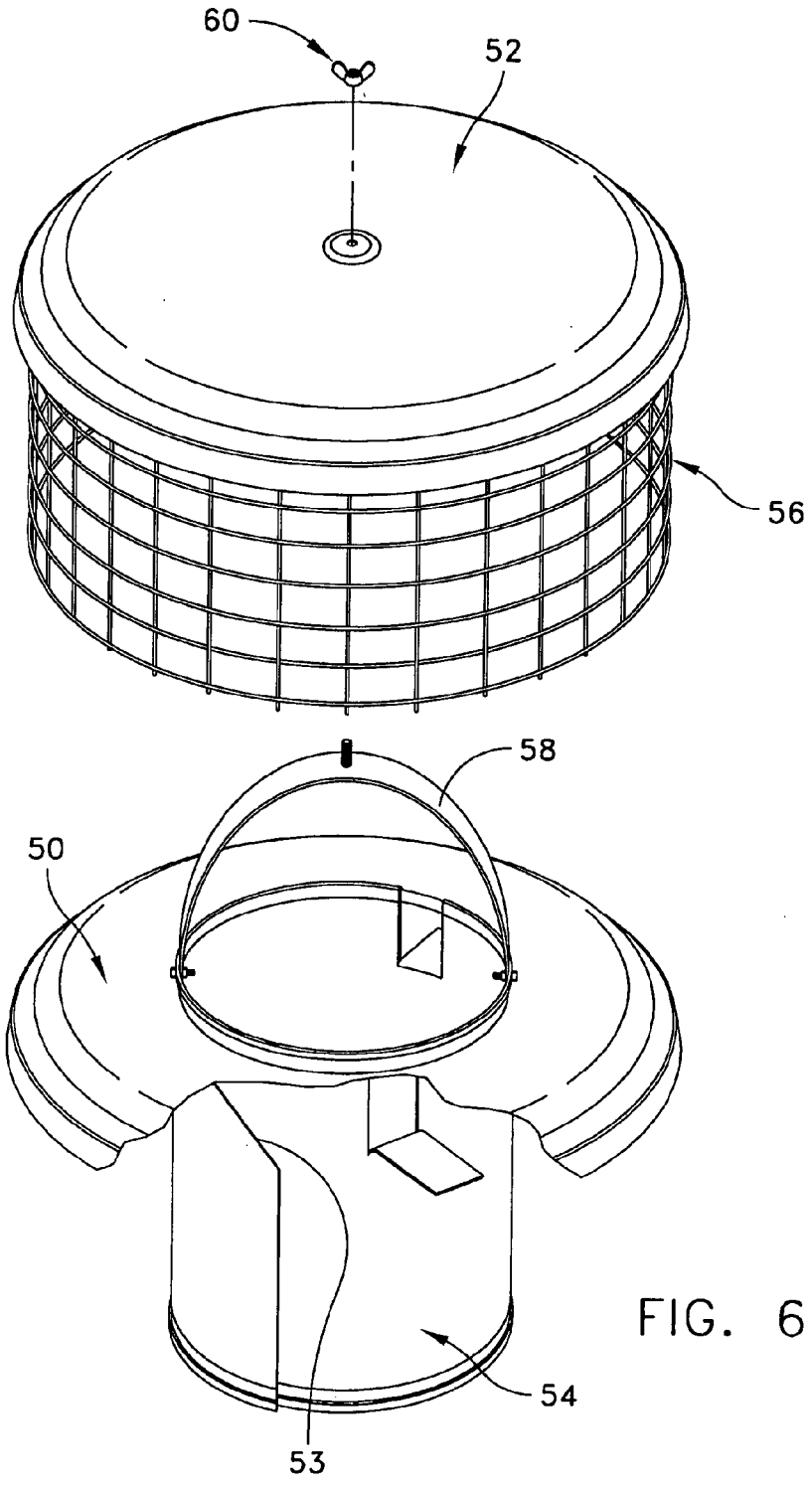
FIG. 6 is an exploded perspective view the chimney cap of FIG. 5.

Another aspect of an embodiment of the present invention relates to the mounting arrangement that enables more universal use of the chimney cap. As discussed above, common chimney and flue designs include both air-cooled or non-air-cooled type chimney enclosures. The air-cooled designs require some venting to operate properly which can be provided by ledges that allow for this venting, as shown in FIG. 4. In embodiments of the present invention, means are provided to form the ledge, or means are provided to attach a cap assembly to the ledge or a ledge kit which allows the single design to be used for either air cooled or non-air-cooled enclosures.

Figure 7:
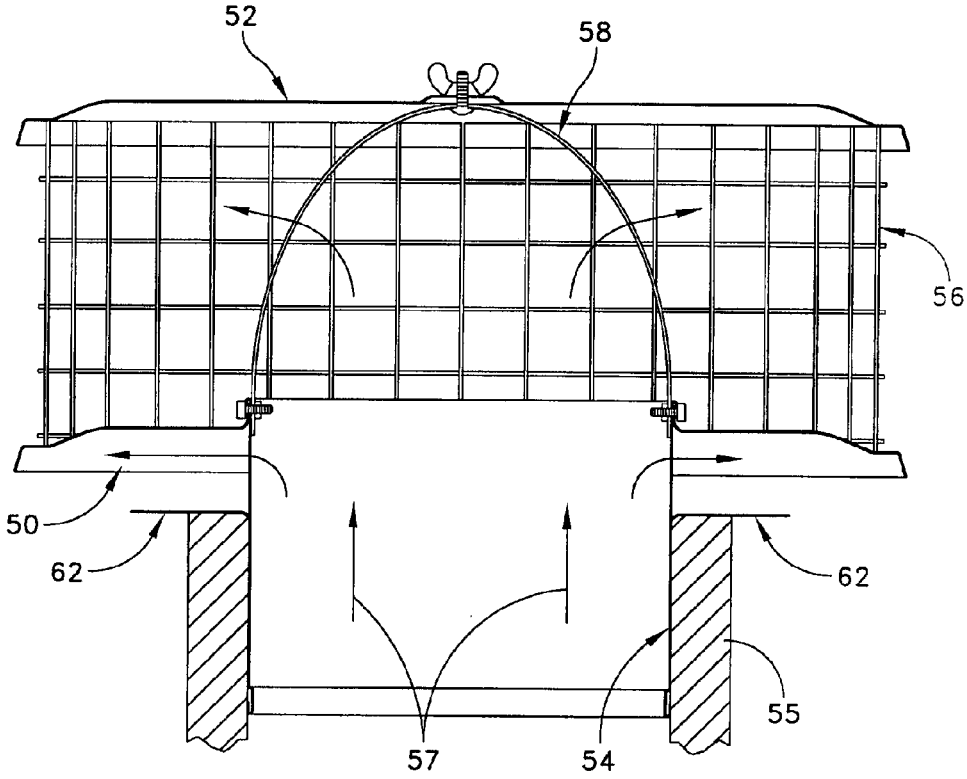
FIG. 7 is a cross-sectional view taken along lines 7-7 of FIG. 5.
Figure 8:
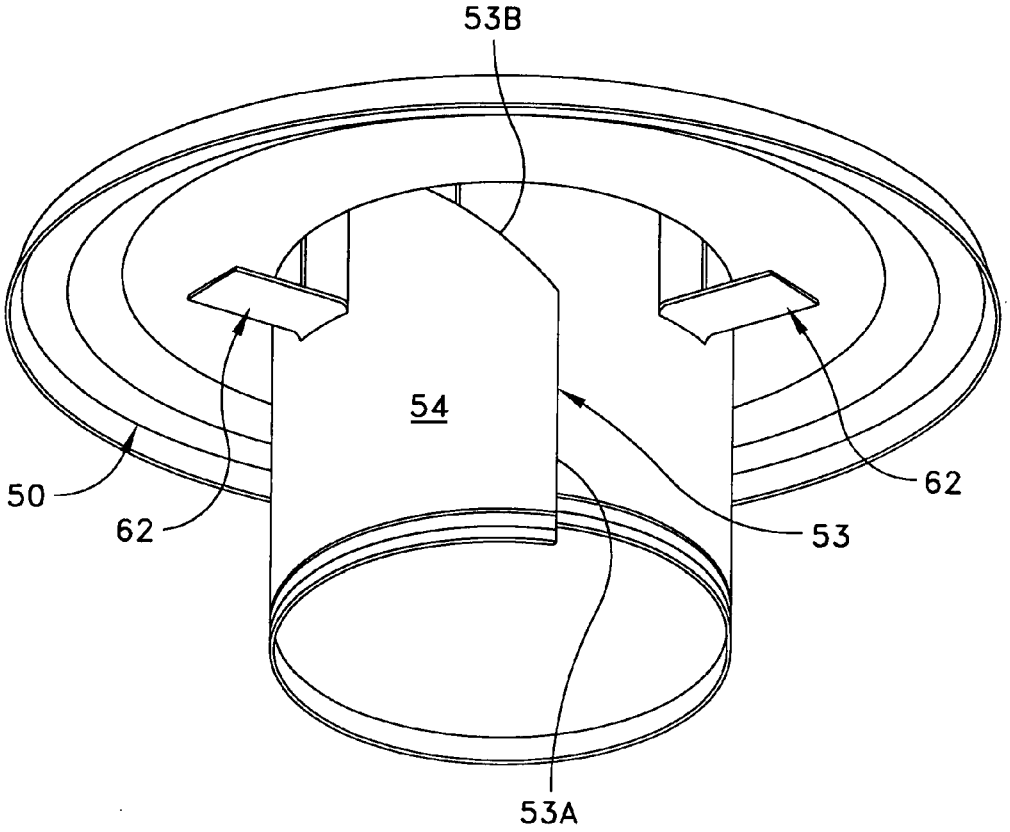
FIG. 8 is a bottom perspective view of the chimney cap of FIG. 5.
Figure 9:
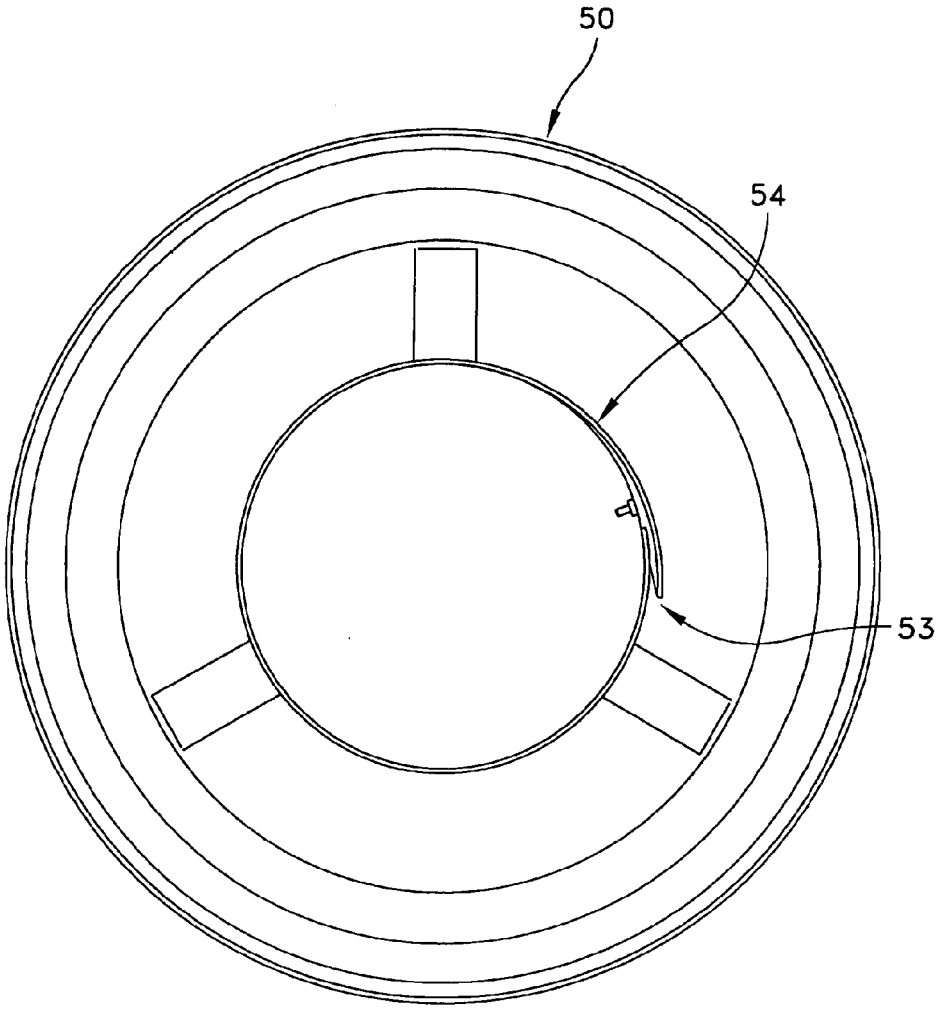
FIG. 9 is a bottom view of the chimney cap of FIG. 5.

In the first embodiment, shown in FIGS. 5-9 the means forming a ledge for support of the collar member from the chimney or flue includes the cut-out member or tab 62. The tab 62 may be formed by cutting out the collar member and bending the cut-out portion. The tab 62 forms a ledge that, as shown in FIG. 7, rests on the top surface of the flue or chimney. In FIG. 7 arrows 57 show the direction of gas flow out of the chimney structure. Although a small amount of flow may occur over each tab 62, the majority of the flow is out through the mesh screen 56.

In the second embodiment, shown in FIGS. 10-11 the means forming a ledge for support of the collar member from the chimney or flue includes the band member 75. In this embodiment, rather than forming the ledge from the collar member itself, a separate member is used to form the ledge, or actually a series of ledges. The band member may be held in place with a band fastener 75A, as shown in FIG. 10. The band member 75 is thus easily adjustable to different vertical positions along the collar member 74. The band member 75 supports three tabs 76 that are disposed about the periphery of the main loop 75B of the band member 75. The tabs 76 form a ledge that, as shown in FIG. 11, rests on the top surface of the flue or chimney structure 71.

In FIG. 11 arrows 77 show the direction of gas flow out of the chimney structure. The flow is basically through the collar member 74, upward and radially out through the top mesh screen 79. FIGS. 10 and 11 also show the base 70, collar member 74, support hoop 78, top 72, top fastener 80 and top mesh screen 79. FIG. 10 also shows the edge of the overlap joint 73 that includes the two aforementioned parts terminating at the pivot fastener 73A which functions as a pivot to assist in the compression of the collar member 74.

In the third embodiment, shown in FIGS. 12-14 the means forming a ledge for support of the collar member from the chimney or flue includes the bolts 95. The bolts 95 form a ledge that, as shown in FIG. 13, rests on the top surface of the flue or chimney 91. In FIG. 13 arrows 97 show the direction of gas flow out of the chimney structure. The flow is basically through the collar member 94, upward and radially out through the top mesh screen 99. FIGS. 12-14 also show the base 90, collar member 94, support hoop 98, top 92, top fastener 100 and top mesh screen 99.

The method of forming a ledge in embodiment of FIG. 13 is similar to the ledge embodiments shown and discussed in FIGS. 19 and 20 below. The bolts are secured to the collar member with any type of fastener that allows them to radially extend away from the collar and across the top of the chimney or flue. For example and not limitation, fasteners to fasten the bolt to the collar can include any fastening means such as rigidly attaching the rods to the collar by soldering or adhering or they can be fastened by collar fasteners that mate with the bolt such as nuts, push-on retainers, clips, slots or screws. Referring to the embodiment of FIG. 13, the bolts are inserted through openings in the collar that allow the bolts to radially extend across the top of the chimney. The bolts are secured to the inside of the collar member by the head of the bolt or any fastener such as but not limited to a mating nut. The bolts are secured to the outside of the collar member by another fastener such as a collar fastening nut.

Figure 17:
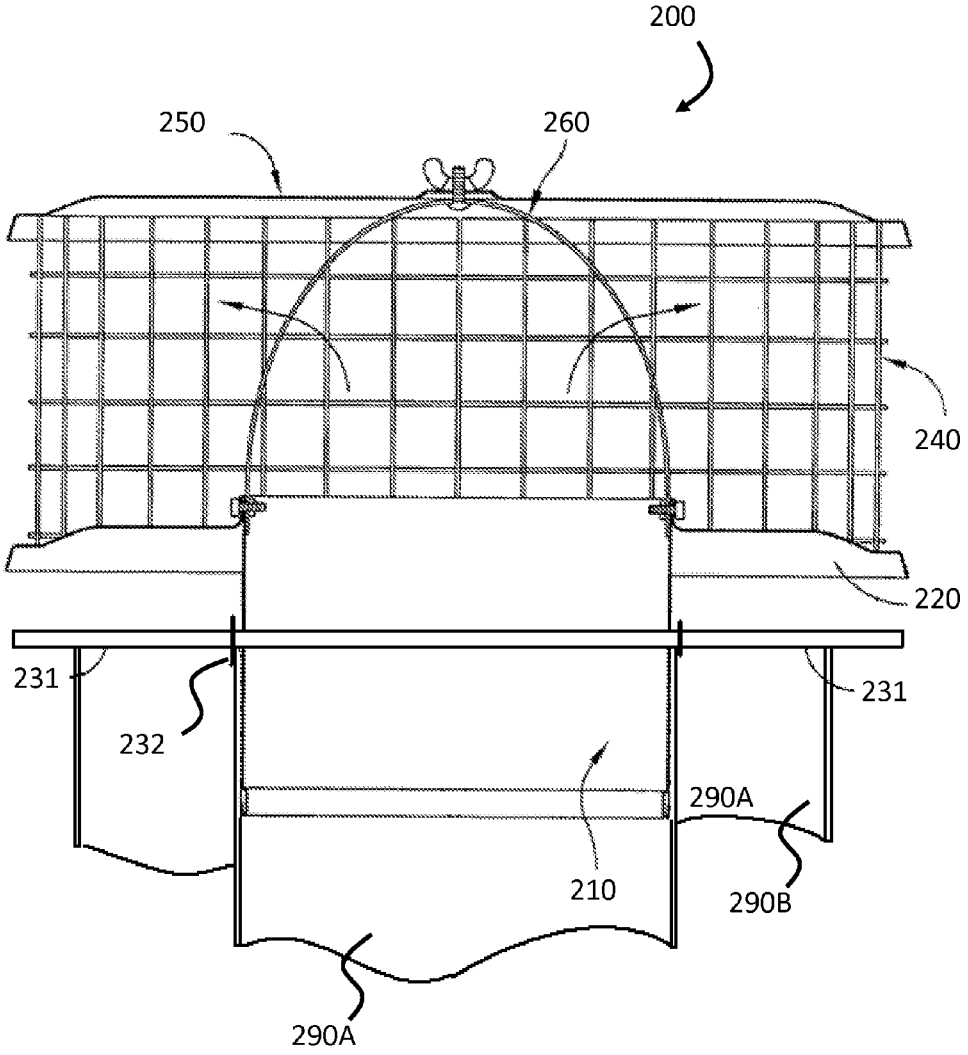
FIG. 17 shows a cross-sectional view of one embodiment of the cap assembly inserted into an air-cooled chimney.

It is understood that although the bolts shown are threaded bolts, the bolt does not need to be threaded and can comprise a rod secured to the collar by any type of fastening means. For example and not for limitation, as shown in FIG. 17, the bolt comprises a non-threaded rod 231 extending through two openings in the collar member 210. The rod 231 has two rod ends extending radially from the collar member 210 and across the tops of chimney enclosure walls 290A and 290B. The rod 231 can secured to the collar member 210 by any fastening means, such as push-on retainers 232 shown. In FIG. 12 there is also clearly shown the edge the overlap joint 93 that includes the two aforementioned segments terminating at the pivot fastener 110 which functions as a pivot to assist in the compression of the collar member 94. Also illustrated is a top termination point 97 which, in this embodiment, is at the top edge 94A of the collar member 94. In the embodiments of FIGS. 12-14 the overlap joint includes a lower segment 93A that extends substantially longitudinal of the collar member and a top segment 93B that extends diagonal to the lower segment 93A enabling more ready compression of the diameter of the collar member 94. The collar member 94 may be attached at its top edge to the base 90 and the top segment 93B is tapered terminating at the base. In embodiments, the top termination point is located close to a pivot such as pivot fastener 110 shown in FIG. 12. The pivot fastener 110 may be a screw or rivet attached at the rim 112 and located at the top end of the top segment 93B. This pivot fastener functions as a pivot point that enables the collar member to be compressed in diameter while the tapered or diagonal edge of the top segment 93B assists in this compression.

It is understood that although FIG. 12 illustrates an embodiment of the taper edge of the top segment 93B as an edge extending diagonally, with both a diagonal portion to a point where the edge fits under the rim of the base 112 and a longitudinal portion from that point to the top termination point 97, the tapered edge can be of any general shape that allows the lower segment 93A to move about the pivot without interference from other cap assembly elements such as the top segment 93B and the base 90. For example, and not for limitation, the taper of the edge of the top segment 93B can be any shape of an edge such as, but not limited, to jagged, curved convex, curved concave, wavy, multi-sectional or boxed edges.

Although the pivot in FIG. 12 is shown as a pivot fastener 110 at the top edge of the collar member, the pivot can be any method of allowing a bottom edge and the bottom portion of the collar member to compress and create a smaller outside circumference. The pivot can comprise any type of fastener movably or rotatably connecting the collar to the base 90 such as, but not limited to a screw, bolt, rivet, or any connector received through a hole or slot in the collar or it can also be a protrusion of a point in the collar that is rotatably received in a recess of the base. The pivot can also be a rigid or semi-rigid fastening means such as but not limited to a weld, crimp mated with the base or any type of fastening that still allows the bottom portion of the collar member to compress through the elasticity of the collar member. The pivot can also be a slit, cut or curve in the edge of the overlap joint that allows the bottom portion of the collar member to compress through the elasticity of the collar member.

In addition, although the embodiments shown have the pivot located near the top termination point of the overlap joint near the top edge of the collar, the pivot can be located at other points on the collar member. For example and not for limitation, a slit can be provided at almost any point of the edge of the overlap joint, such as near the collar member upper edge 94A, that allows the collar member bottom edge 94B to compress. Similarly, the pivot can be provided by other fastening means, as described above, at various locations of the edge of the overlap joint 93 or collar member 94.

As shown in FIG. 12, the bottom edge 94B of the collar member is able to be compressed by the overlap joint lower segment 93A rotating about the pivot. The compression of the bottom edge 94B, as part of a compressible portion of the collar member, can be compressed to a compressed circumference smaller than the chimney or flue opening it will be inserted into. In this embodiment, the top edge 94A and the top portion of the collar member has relatively little ability to compress. As shown, the top edge is attached at various points on the base. The collar member bottom edge 94B is open and more elastic and compressible. In these embodiments, the outer circumference at the bottom edge 94B is typically biased to be of a larger size than the outer circumference at the top edge 94A. This is due to the elasticity of the collar member material and this bias helps provide friction between the outer surface of collar member and the inside of the chimney or flue when the collar is installed. The friction from the bottom edge, or the bottom portion, of the collar member is helpful because it helps prevent the collar from "walking out" of the chimney when it is subjected forces such as wind. The relative size of the bottom edge outer circumference to the top edge outer circumference can be any size that still allows appropriate compression, but in some embodiments the relative size is about at least 1 percent larger, or at least about 3 percent larger in other embodiments.

In one embodiment, the manufacture and assembly of the cap assembly assist in providing some of the features of the invention. In one embodiment, the collar member is formed by rolling a sheet of metal into an unclosed cylindrical shape. This shape is generally of a diameter slightly larger than the diameter of the base opening to which it will be attached. Because of the general elastic aftereffect properties of sheet metal in this shape, the cylinder is biased to elastically maintain this shape. In some embodiments, the elasticity of the cylinder is enhanced by further conditioning the edges such as by rolling, crimping, hemming or creating a seam near the edge. To constrain and attach the top edge of the collar to the base, the collar is slightly compressed and then attached to the base. This compression and attachment gives the top edge of the collar member some of its rigidity. The bias of the other end of the collar member, the compressible portion, to want to maintain its slightly larger diameter than the base creates the bias for the bottom edge and bottom portion of the collar member to be larger than the base opening.

It is also understood that although the terms top and bottom edge of the collar member are used, the terms in this description are intended to incorporate locations on the collar close to the edges of the collar member, not only exactly on the edges. For example, it is understood that the pivot can be located or fastened to locations close to the top edge of the collar including exactly on the top edge. It is also understood that the friction of the member against the inside of the chimney can be provided by other collar portions near the bottom edge including exactly on the bottom edge. It is also understood that a top and bottom portion of the collar are portions of the collar that include, but are not limited to, the top and bottom edges respectively. In embodiments, the bottom portion of the collar member is the compressible portion of the collar member.

Figure 15:
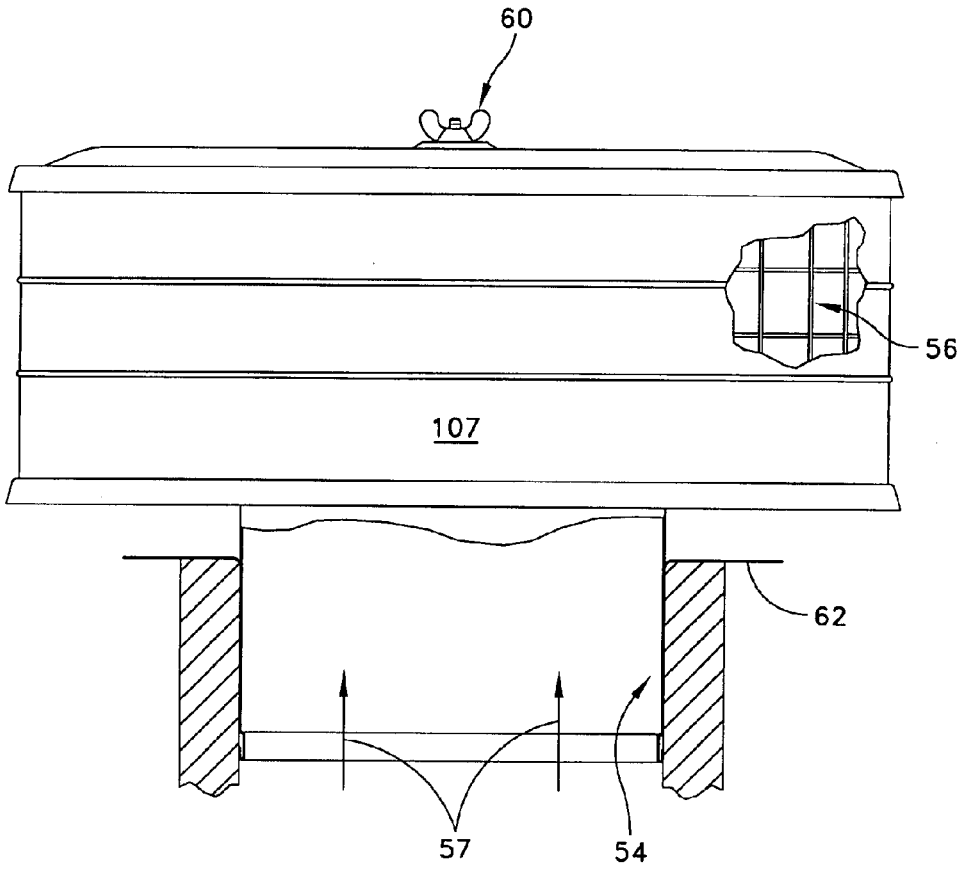
FIG. 15 shows an alternate embodiment using a sleeve.
Figure 16:
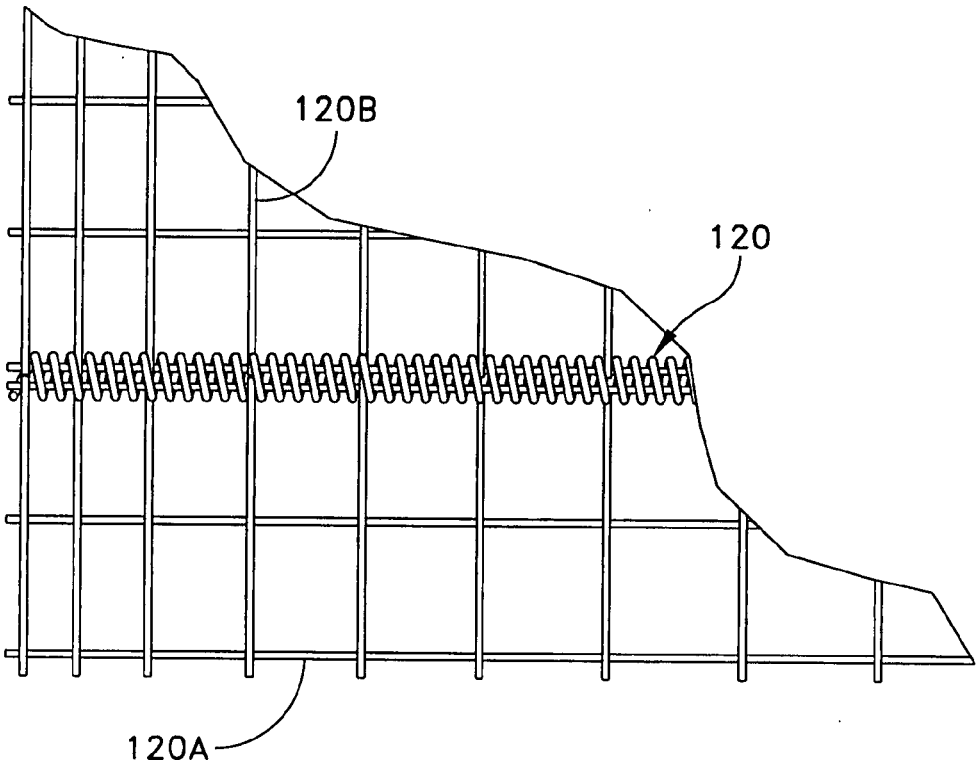
FIG. 16 shows an alternate mesh arrangement.

FIG. 14 is substantially the same as FIG. 13 but has an added damper 105 which may be controlled in a number of different ways. FIG. 15 is a view like that shown in FIG. 7 but with an added windshield 107. FIG. 16 illustrates an attachment at 120 that enables separate mesh sections 120A and 120B to be interconnected. It is evident from the description of the preferred embodiments that the objects of the invention are attained in that a chimney cap is provided which will allow the cap collar to be more readily compressible for insertion into a chimney or flue.

FIG. 17 illustrates a chimney cap assembly 200 embodiment where the bolt to form the ledge comprises a threaded or non-threaded rod 231 extending through two openings in the collar member. The rod 231 has two ends extending radially from the collar member 210 and across the chimney or flue top. In this illustration, the chimney comprises a double walled chimney with an inner wall 290A and an outer wall 290B. The rod 231 can secured to the collar member by any fastening means, such as push-on retainers 232 shown.

Figure 18:
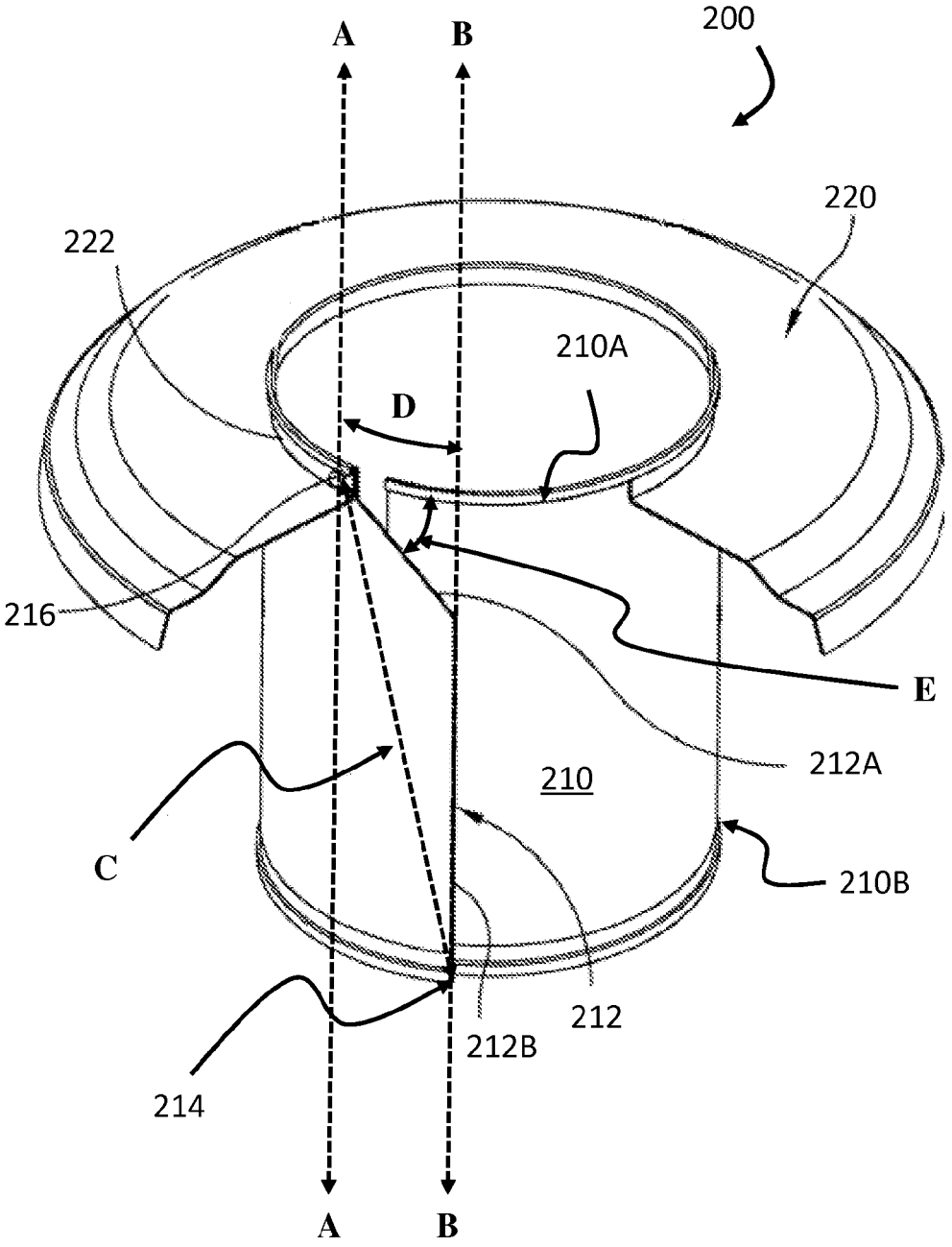
FIG. 18 shows a perspective view of one embodiment of a chimney cap assembly.

FIG. 18 illustrates an embodiment of the chimney cap assembly 200 where the collar member 210 and the base 220 provide a universal cap assembly to which various other components or top configurations can be added. As shown, the collar member 210 has an overlap joint with an overlap joint edge 212. As described above, the overlap joint has a bottom termination point 214, a pivot 216 and a joint taper between these two elements, shown here as dotted line C. This particular embodiment is also shown with the overlap joint having a lower segment with a lower segment edge 212B that extends substantially longitudinal of the collar member and a top segment with a top segment edge 212A that extends from a transition point to the top termination point generally located near the pivot 216, here a pivot fastener. Also shown are two dotted lines A and B representing a longitudinal position of the pivot 216 and bottom termination point 214 respectively about the collar member 210 circumference. Between these lines is a receding longitudinal offset, shown as line D, between the pivot 216 and the bottom termination point 214 about the circumference of the collar member 210. This offset D is defined to be a distance that provides an overlap of ends of the collar member to close a portion of the collar member when compressed. The offset D is also defined so that it is not too long to interfere with installation or waste material during manufacturing of the collar member 210. In embodiments, the offset D can be any size large enough to ensure there is an overlap between the inside edges of the collar member 210. For example only, some embodiments have an offset D range between one eight and three inches and others having a range between one half and two inches.

Although the line A and offset D are shown as measured from the bottom termination point on the bottom edge of the collar member, it is understood that in some embodiments, line A and offset D may be measured from a point on a leading edge of the overlap joint such as a leading edge point at a point of the leading edge longitudinally furthest from the pivot. In these embodiments, this would define an overlap joint with a top segment edge, a leading edge that provides an overlap and a lower segment edge. For these embodiments, the lower segment edge may recede from the leading edge and therefore the bottom termination point at the bottom edge of the collar member does not necessarily have to create a receding longitudinal offset in relation to the pivot.

FIG. 18 also shows the angle E which represents the smallest angle measured between the bottom side of the base 220 and the edge of the overlap joint 212. As shown, this angle is the smallest angle between the bottom side of the base 220 and the top segment edge 212A about the pivot 216. This angle E represents the most likely portion of the overlap joint edge 212 to contact the base 220 when the collar member bottom edge 210B is compressed (as part of the collar member compressible portion) in embodiments such as is shown here. This angle E should allow for sufficient movement of the overlap joint edge 212 due to its pivot about the pivot 216. The angle is generally dependent upon the size of the assembly, however, in embodiments, the angle E is at least about 6 to 19 degrees or more preferably about 11 to 15 degrees. It is also understood that embodiments can be made that allow the pivot of the overlap edge without being obstructed by the base 220 (such as by providing slots in the base).

As can be seen in FIG. 18, the joint taper C allows the edge of the overlap joint 212 to take many shapes while minimizing the exchange of gases, guiding the collapsing of the collar member and allowing the bottom edge 210B to collapse without being obstructed. As shown, the joint taper C allows the overlap joint edge 212 to pivot about the pivot 216 so that the collar member bottom edge 210B can be collapsed so that it's outside circumference will be smaller than the chimney or flue. The collar member top edge 210A is generally fastened to the base making the outside circumference at this top portion of the collar member generally rigid and inelastic. The same functionality can be obtained by having generally any shape of an overlap joint edge such as, but not limited, to jagged, curved convex, curved concave, wavy, multi-sectional or boxed edges.

It is also understood that although the embodiments shown have the edge of the overlap joint on the outside of the collar circumference, similar functionality can also be provided by having the joint taper C and the edge of the overlap joint on the inside of the collar member.

Figure 19:
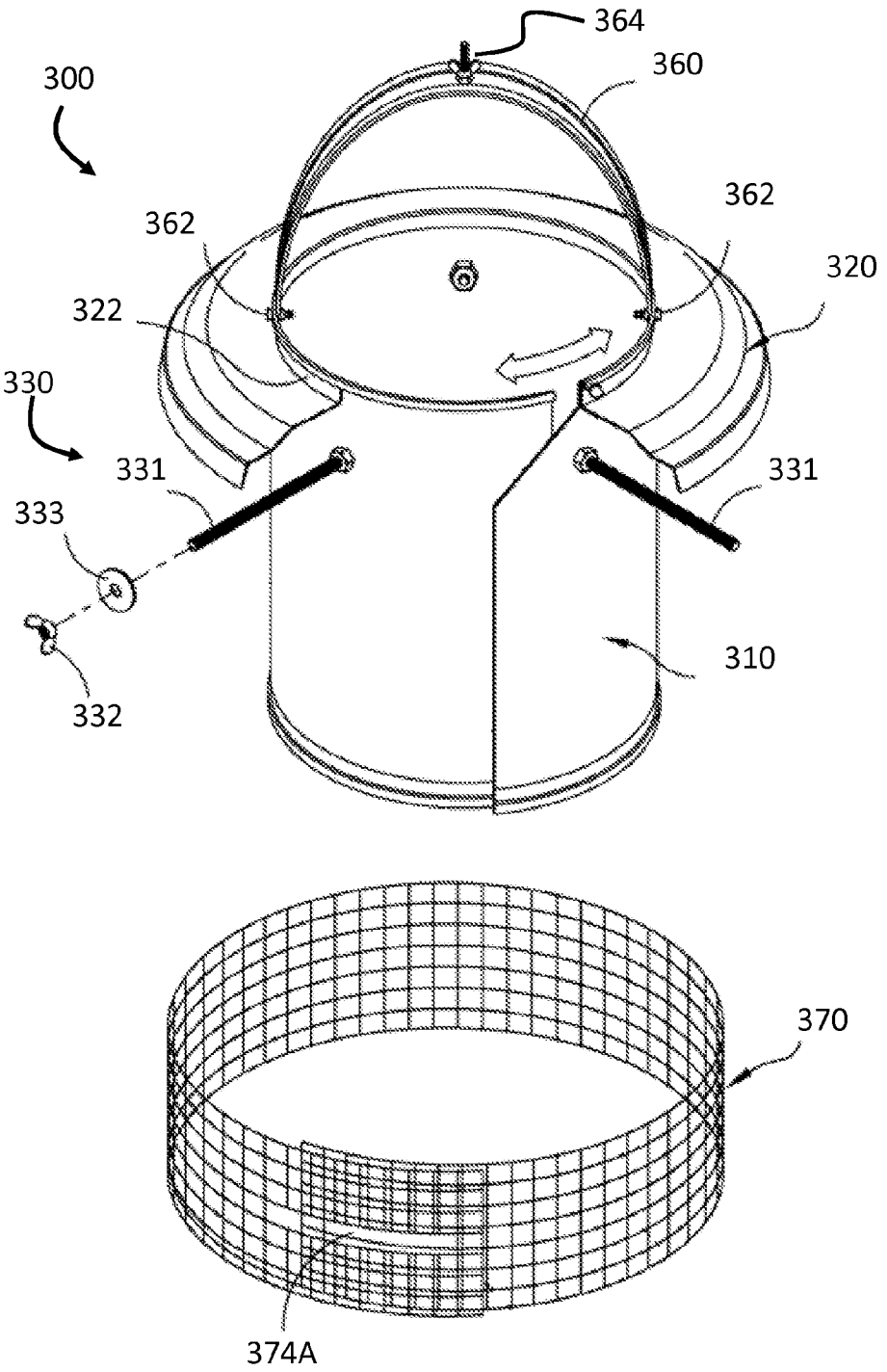
FIG. 19 shows a perspective view of one embodiment of a chimney cap assembly with one embodiment of a means to form a ledge and a lower mesh.
Figure 20A:
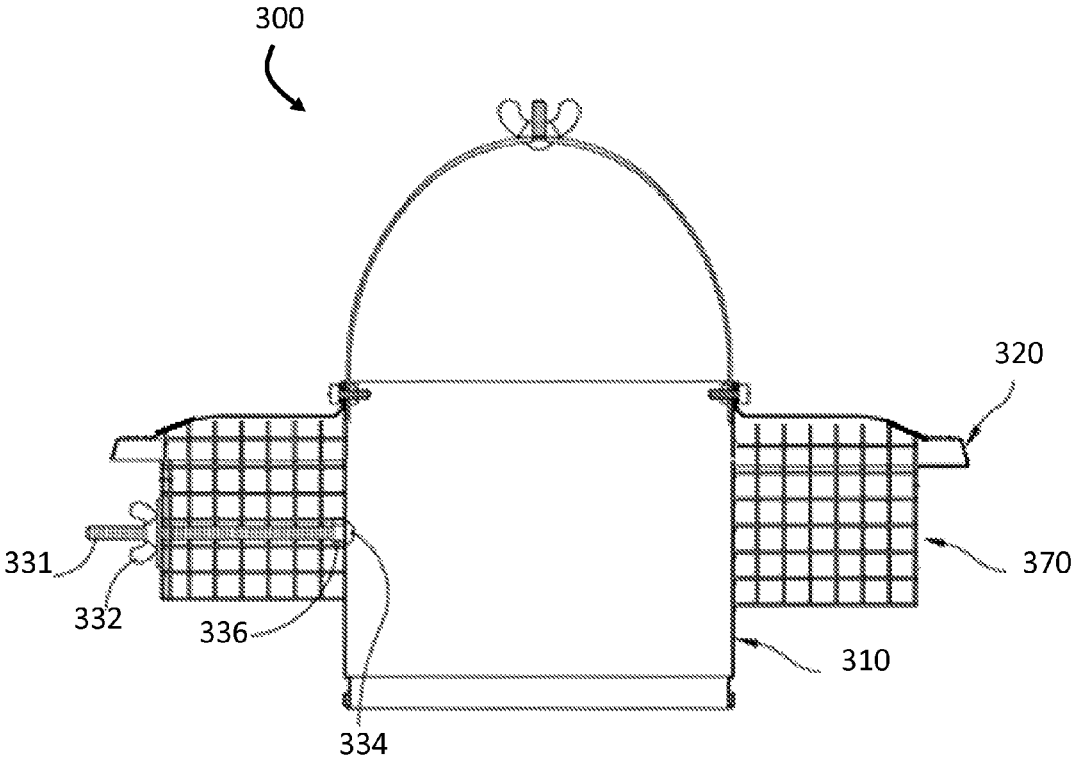
FIG. 20A shows a cross-sectional view of one embodiment of the chimney cap assembly with one ledge embodiment and a lower mesh installed.
Figure 20B:
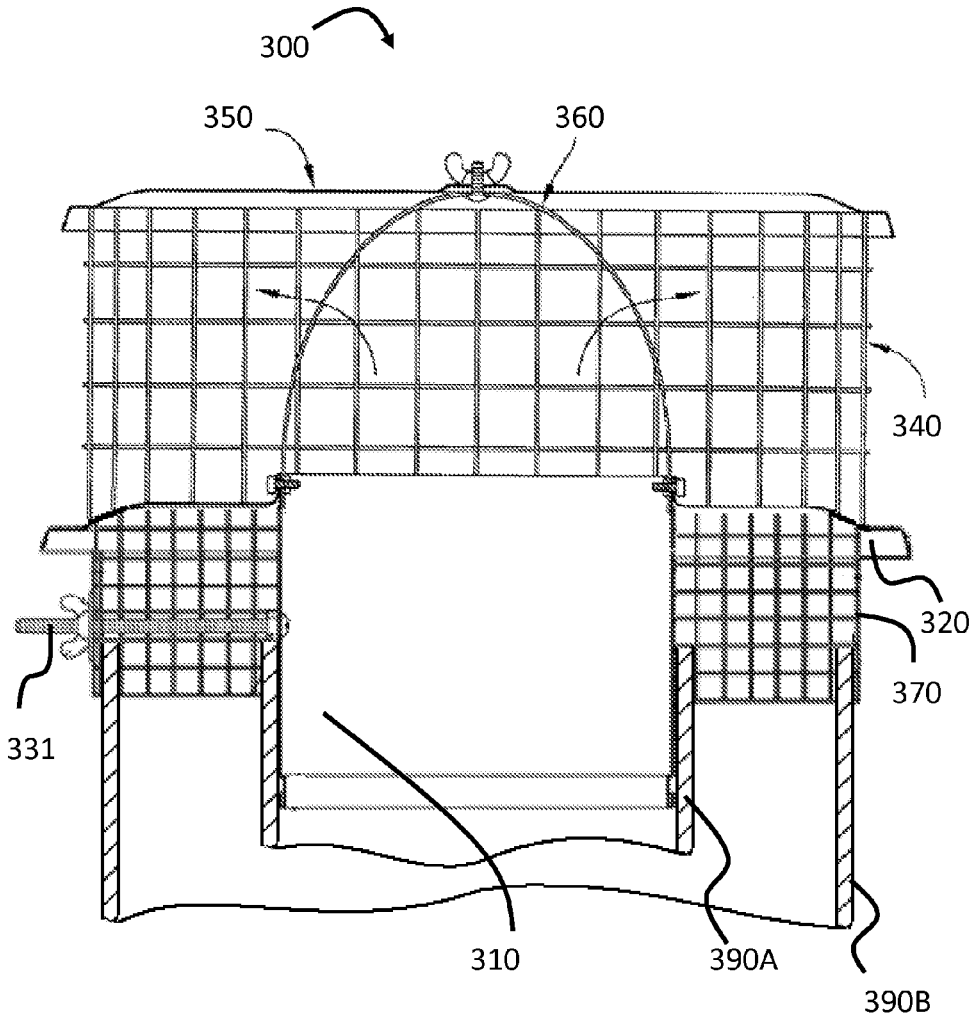
FIG. 20B shows a cross-sectional view of one embodiment of the chimney cap assembly with a ledge embodiment, a lower mesh together with a top mesh screen and top installed on an air-cooled chimney.

FIGS. 19 and 20 illustrate the ability of a universal cap assembly (shown with a means to secure a top) to be incorporated with ledges 330 and a lower mesh structure 370. Embodiment of incorporating elements such as ledges, collar members and lower mesh into a universal cap assembly or a chimney cap assembly can be similar to those described in co-pending U.S. patent application Ser. No. 12/478,838 to William C. Paynton et al. filed Jun. 5, 2009 and entitled "CHIMNEY CAP", the entire contents of which are herein incorporated by reference. In one embodiment shown, the collar member 310 is adapted to incorporate bolts 331 to function as a ledge 330. The adaptation shown is a slot, or hole in the collar member allowing the bolt 331 to go through a portion of the collar member 310 while being small enough to allow the head of the bolt 331 or a nut to retain the bolt 331 in the collar member 310. As shown, a lower mesh structure 370 is sized to fit under the base 320 and around the outside circumference of the chimney or flue. Details of the ledge and mesh embodiment are discussed below and shown in FIGS. 20A-20B.

Although not required, FIG. 19 also shows a means to secure a top to the universal cap assembly. Any means of securing the top to the cap can be used. As shown, a hoop 360 is attached to the base 320 or collar member 310 by hoop fastener 362 such as but not limited to bolts, screws, clips, rivets, welds, adhesives or any other fastening means. The hoop 360 also has a top fastening means, shown here as a top fastener 364, to fasten a top (not shown) to the hoop 360 and the cap assembly 300. Any cap fastening means may be used, such as but not limited to the bolt and wing nut shown.

Reference is now made to FIG. 20A that shows an embodiment of the chimney cap assembly 300 with a ledge and a lower mesh structure 370. FIG. 20A illustrates the lower mesh structure 370 as supported below the base 320. The primary support of the lower mesh structure 370 is by means of a series of bolts 331 that are each supported from the collar member 310 and each extend radially. This illustrates the bolt head 334 as secured to the collar member 310. For that purpose a nut 336 may be tightened against the collar member 310 and the bolt head 334. At the outer end of each of the bolts 331 there may be provided a washer 333 (see FIG. 19 with washer larger than mesh apertures) and a wing nut 332 that engages with the threaded bolt 331. As shown in FIG. 19, in one embodiment, three such support bolts 331 are provided. Although not required, some embodiments can have two bolts 331 diametrically disposed to each other. Also, greater than three bolts may also be employed. It is preferred that the bolts be evenly spaced about the perimeter of the base and collar member 310. Refer to FIG. 19 for an illustration of the use of three bolts 331 being disposed each at a relative spacing of generally about 120 degrees to the adjacent one thereof. The wing nuts 332 are tightened against the washer 333 to hold the lower mesh structure 370 in place.

FIG. 20B shows one embodiment of the chimney cap assembly as installed on an air-cooled chimney. As shown, the chimney cap assembly 300 has the lower mesh structure 370, the collar member 310, the base 320 and a bolt 331 forming a ledge across the chimney's inner wall 390A and outer wall 390B. This embodiment also shows the hoop 360, top 350 and the top mesh screen 340 as part of the assembly 300.

Figure 21A:
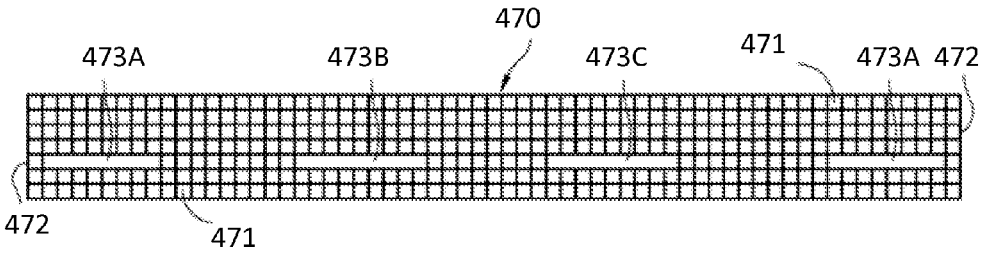
FIG. 21A-21C shows multiple views of embodiments of the lower mesh.
Figure 21B:
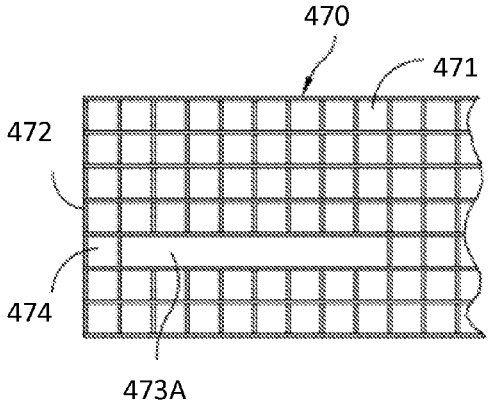
Figure 21C:
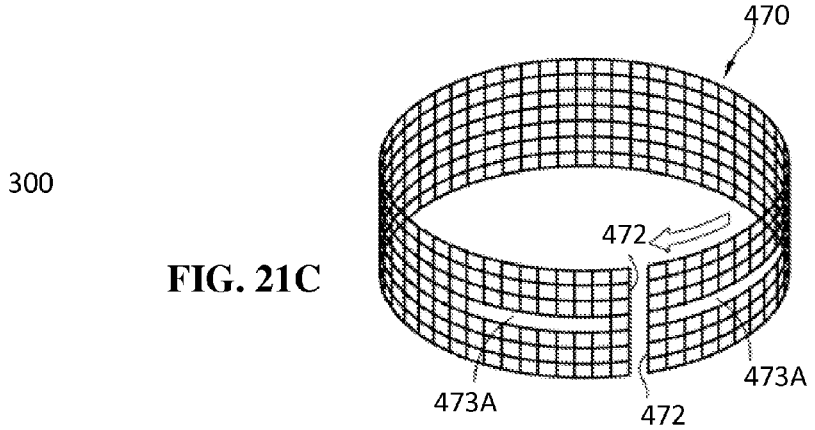

Reference is now made to FIGS. 21A-21C for further explanations relating to the lower mesh structure 470. The lower mesh structure 470 is in the form of a wire grid, such as a welded or woven wire cloth, and in the illustrated embodiment is comprised of a series of longitudinal and latitudinal wires that form square or rectangular grid openings or apertures 471. In one embodiment of the mesh construction illustrated in FIGS. 21A and 21B at opposed ends 472 there are provided respective elongated slots 473A. These slots 473A are preferably not open to the very ends 472 of the mesh. For example, in the embodiment illustrated in FIGS. 21A and 21B, each of the slots terminates before the ends 472 leaving at least one grid member such as illustrated at 474 in FIG. 21B. In the embodiment illustrated in FIGS. 21A and 21B, the ends 472 are meant to overlap so that the slots 473A can likewise overlap as is illustrated in FIG. 19. As noted in FIGS. 21A and 21B, there is essentially only a single overlapping slot 473A, provided once the ends 472 are made to overlap such as particularly shown in FIG. 19. FIG. 21C also illustrates by the arrow, the manner in which the overlapping can be changed so as to change the overall diameter of the lower mesh structure 470. In this way, the lower mesh structure 470 can be more readily fitted to various chimney or flue structures.

It is understood that although FIGS. 21A-21C illustrate the slots 473A not being open to the edge of the mesh, it is understood that it is not required to close the slots and other means to retain the mesh with the cap assembly can be used. For example and not for limitation, clips can be provided that secure the ends 472 of the mesh together, or the friction from the ledge bolts can also be sufficient to eliminate the need for closing the slots.

In this regard, refer to FIG. 20A that shows the lower mesh structure 370 as fitted below the base 320 of the chimney cap. Thus, in accordance with the present invention there is provided a relatively simple way of adjusting the diameter of the lower mesh structure 370 so that it can match a different size flue or chimney structure. The wing nut 332 may then be screwed inwardly so as to hold the mesh structure 370 at the proper position such as illustrated in FIG. 20A. Thus, in one embodiment of the present invention a single pair of overlapping slots (see 374A of FIG. 19) is provided to set the diameter adjustment of the lower mesh structure 370.

An alternate embodiment is illustrated in FIG. 21A in which the lower mesh structure is laid out flat and elongated, there are end slots 473A but also toward the middle of the lower mesh structure are respective slots 473B and 473C. The slots 473B and 473C may be shorter in length than each of the slots 473A. The embodiment illustrated in FIG. 21A is one embodiment for a chimney structure in which there are three support bolts or rods. By providing the multiple slots illustrated in FIG. 21A, this provides some additional latitude as far as the adjustment of the diameter is concerned. One bolt could be accommodated in the end slots 473A and second and third bolts would be accommodated in respective slots 473B and 473C.

Figure 22:
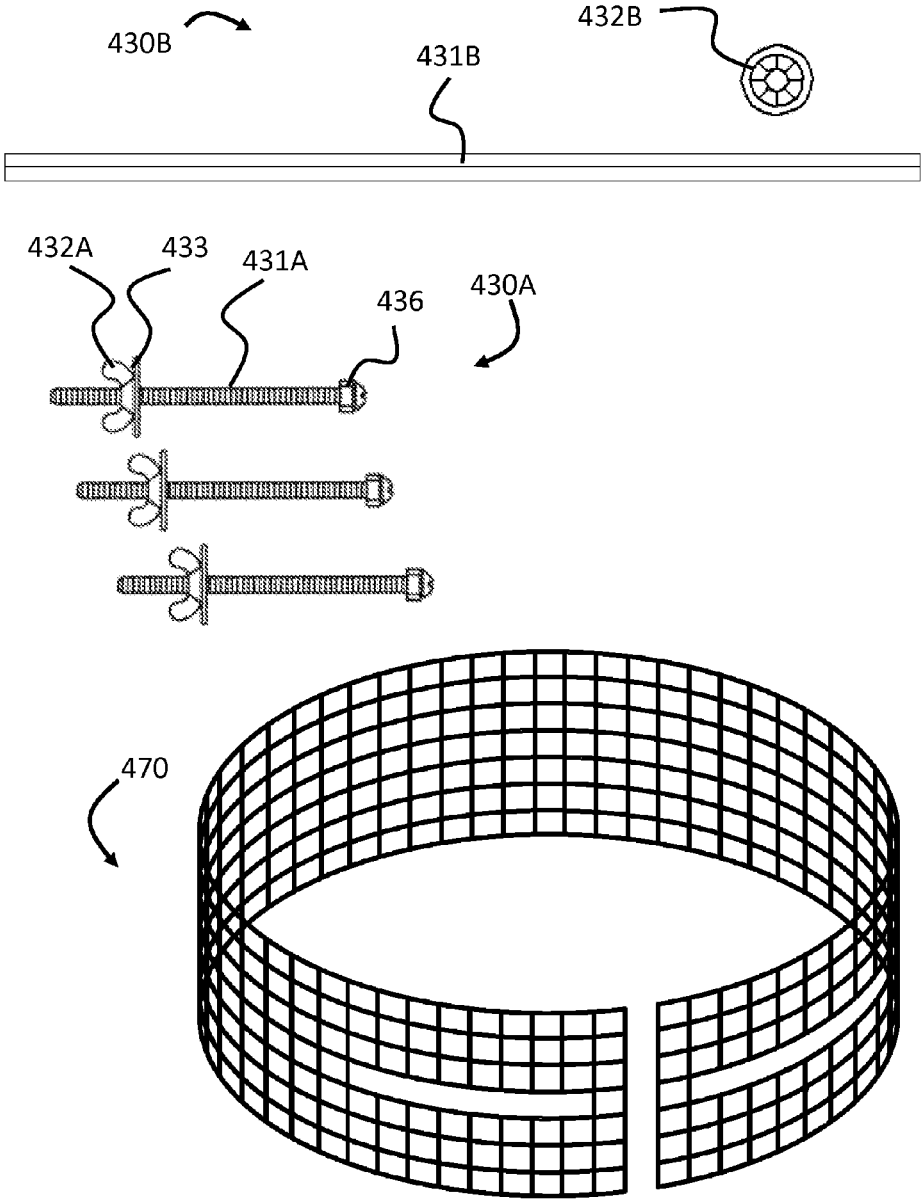
FIG. 22 shows example elements of a universal kit with ledge and lower mesh structure components.

In one embodiment, it is possible to separate the chimney cap assembly and the ledge and mesh functionality. In one embodiment, it is possible to provide a universal kit that has predetermined components. The components are similar to the components described above with FIGS. 19-21. An example embodiment of a universal kit is shown at FIG. 22 comprising any means to create a ledge together with a lower wire mesh. As shown, one embodiment of a means to create the ledge 430A comprises a bolt 431A, a collar fastening nut 436, a mesh fastening wing nut 432A and a washer 433 that will cooperate with features on the collar member, such as slots to receive the bolt 431A. Also shown is another means to create the ledge 430B comprising a bolt 431B and one or more push-on retainers 432B to secure the bolt 431B to the collar member and/or the lower mesh structure 470. It is understood that the dimensions of kit components will depend on the size of the chimney cap which will generally depend on the size of the chimney or flue that the cap will be installed on. Listed in the table below are example kit components for embodiments of three general sizes of chimneys or flues.

| Kit Size | Range of Chimney Inside Diameter | Kit Elements | Range of Quantity of Elements | Other Element Properties of One Embodiment |
|---|---|---|---|---|
| Small | About 5.5" to 6.5" | Bolt | 1-4 ea | At least about 3 inches long |
| | | Collar Fastener Nut | 1-4 ea | Fitted to mate with Bolt |
| | | Washer | 1-4 ea | Fitted to mate with Bolt |
| | | Mesh Fastener Wing Nut | 1-4 ea | Fitted to mate with Bolt |
| | | Wire Mesh with Slots | 1 | About 36 inches to 48 inches elongated length, about 4 inches width |
| Medium | About 7.5" to 8.5" | Bolt | 1-4 ea | At least about 4 inches long |
| | | Collar Fastener Nut | 1-4 ea | Fitted to mate with Bolt |
| | | Washer | 1-4 ea | Fitted to mate with Bolt |
| | | Mesh Fastener Wing Nut | 1-4 ea | Fitted to mate with Bolt |
| | | Wire Mesh with Slots | 1 | About 42 inches to 54 inches elongated length, about 4 inches width |
| Large | About 9.5" to 10.5" | Bolt | 1-4 ea | At least about 4 inches long |
| | | Collar Fastener Nut | 1-4 ea | Fitted to mate with Bolt |
| | | Washer | 1-4 ea | Fitted to mate with Bolt |
| | | Mesh Fastener Wing Nut | 1-4 ea | Fitted to mate with Bolt |
| | | Wire Mesh with Slots | 1 | About 48 inches to 72 inches elongated length, about 4 inches width |

Although the invention has been illustrated and described in detail, it is to be clearly understood that the same is by way of illustration and example only and is not to be taken by way of limitation. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. Although this invention has been described in the above forms with a certain degree of particularity, it is understood that the present disclosure has been made only by way of example and numerous changes in the details of construction and combination and arrangement of parts may be resorted to without departing from the spirit and scope of the invention.

We claim:

1. A universal kit for a collar member of a chimney cap to be inserted into a chimney or flue, said kit comprising:

a lower mesh structure having discharge openings, the lower mesh structure capable of being rolled upon itself to have an outside circumference larger than an outside circumference of the chimney or flue;

the lower mesh structure having at least one elongated slot, the at least one elongated slot comprising at least two or more open cells of the lower mesh structure whereby the outside circumference of the lower mesh structure is capable of being varied to frictionally engage the outside circumference of the chimney or flue;

at least one support rod sized to extend from the collar member of the chimney cap through the at least one elongated slot, the at least one support rod having a support rod body whereby the support rod body includes a bolt body extending outward radially from the collar member when installed on the chimney or flue and forming a ledge for supporting the collar member from the chimney or flue; and a fastener to secure the at least one support rod to the lower mesh structure and the chimney cap whereby the lower mesh structure is wrapped around the outside circumference of the chimney or flue and secured to the chimney cap when installed on the chimney or flue.

2. The universal kit of claim 1 wherein:

the lower mesh structure is capable of being wrapped around the outside circumference of the chimney or flue to stabilize a gap between an inner wall and an outer wall of an air-cooled chimney.

3. The universal kit of claim 1 wherein the at least one support rod is at least about four inches long.

* * * * *